US005269120A

United States Patent [19]

Holmes

[11] Patent Number: 5,269,120

[45] Date of Patent: Dec. 14, 1993

[54] SYSTEM FOR MARKING AND INSTALLING CLOSURES

[75] Inventor: Jack H. Holmes, Cowiche, Wash.

[73] Assignee: Kwik Lok Corporation, Yakima, Wash.

[21] Appl. No.: 583,927

[22] Filed: Sep. 17, 1990

[51] Int. Cl.[5] ..... B65B 51/08; B65B 57/02; B65B 61/02

[52] U.S. Cl. ..... 53/411; 53/64; 53/417

[58] Field of Search ..... 400/121, 124, 583.4; 53/64, 131.2, 131.4, 131.5, 411, 417, 138.3, 139.1, 507

[56] References Cited

U.S. PATENT DOCUMENTS 2,705,100 3/1955 Paxton et al. .
3,061,983 11/1962 Irwin .
3,163,969 1/1965 Irwin et al. .
3,163,972 1/1965 Irwin .
3,190,053 6/1965 Tobey .
3,910,811 10/1975 Paxton et al. .
4,077,187 3/1978 Paxton .
4,284,362 8/1981 Jackson et al. ..... 400/124
4,332,193 6/1982 Noyes ..... 53/411 X
4,831,809 5/1989 Ballestrazzi et al. ..... 53/64
4,933,867 6/1990 Ishigaki ..... 400/121 X

*Primary Examiner*—John Sipos
*Assistant Examiner*—Linda B. Johnson
*Attorney, Agent, or Firm*—Seed and Berry

[57] ABSTRACT

A bag closing system which includes; a closer with a closing roll, a pick, and a closure break-off mechanism that are driven by stepper motors under the control of a central processing unit, fault detectors for sensing operating faults, read only memory for storing the operating program and historical data, a display that indicates the system status, I/O drivers for providing bi-directional communications with a remote processing unit, memory for driving the display and programmed messages to be printed, and; a printer that has a stationary dot matrix impact print head that prints, using a cold-foil ribbon driven by a stepper motor, on closures moved past the print head, an out-of-foil detector and a closure sensor for preventing printing without a closure in front of the print head, and a printer head driver for determining which impact wires must be driven to print the message and for driving the determined wires.

10 Claims, 26 Drawing Sheets

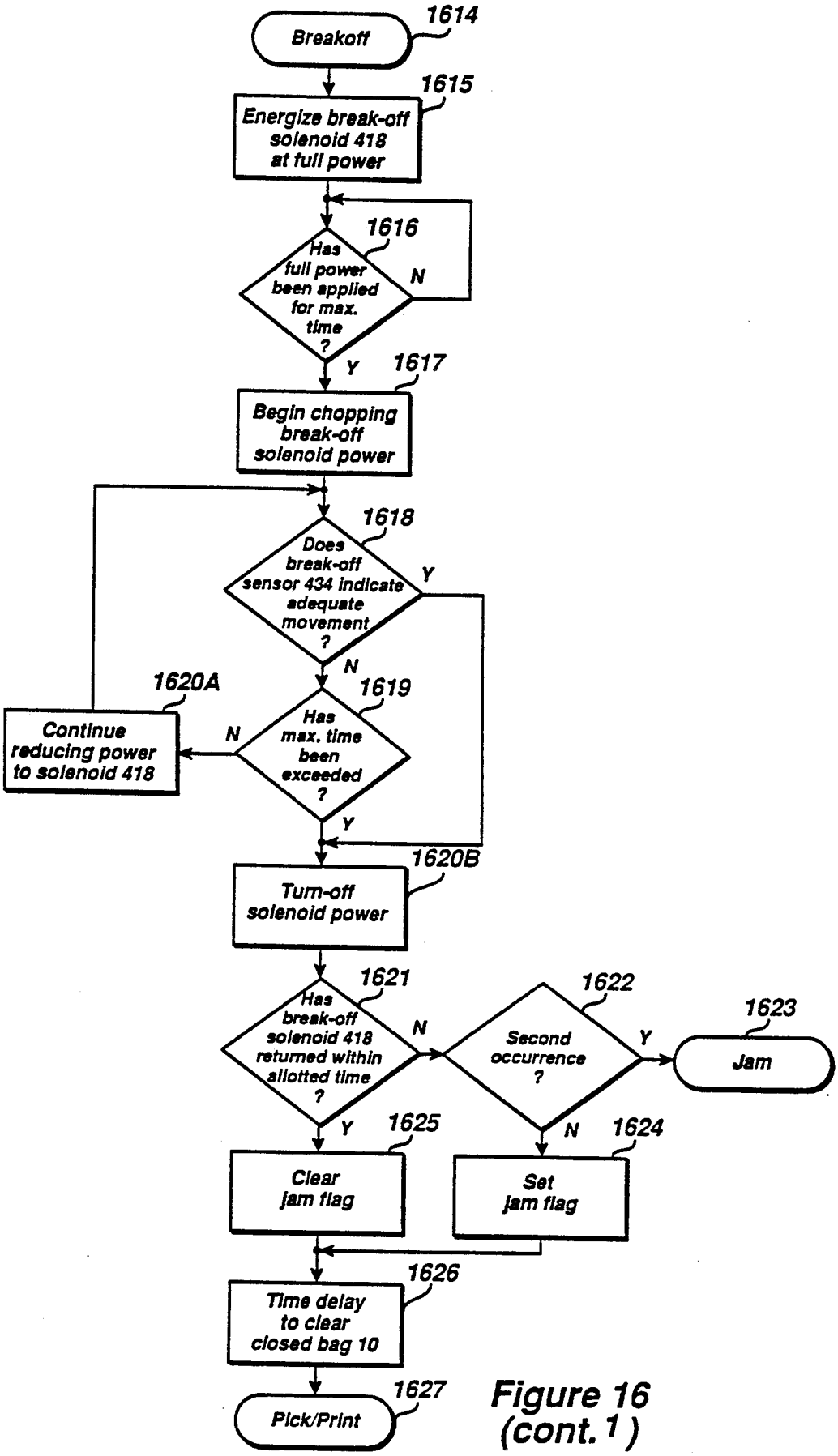
Figure 16 (cont. 1)

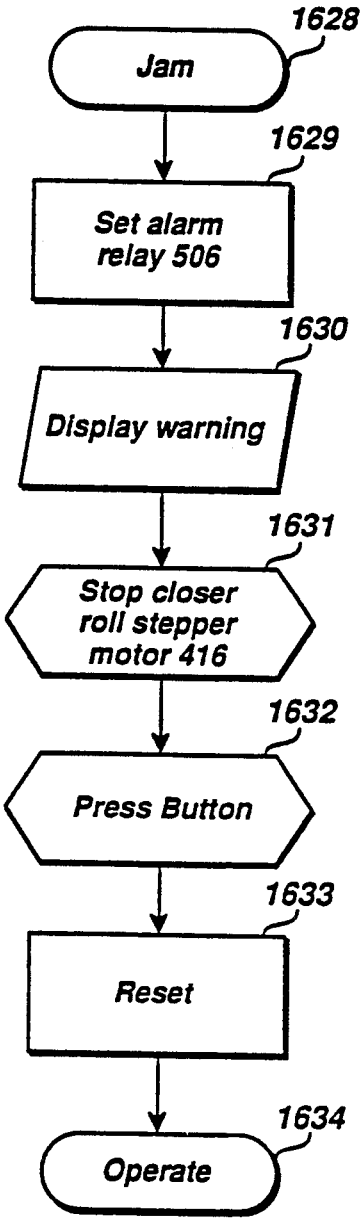
Figure 16 (cont. 2)

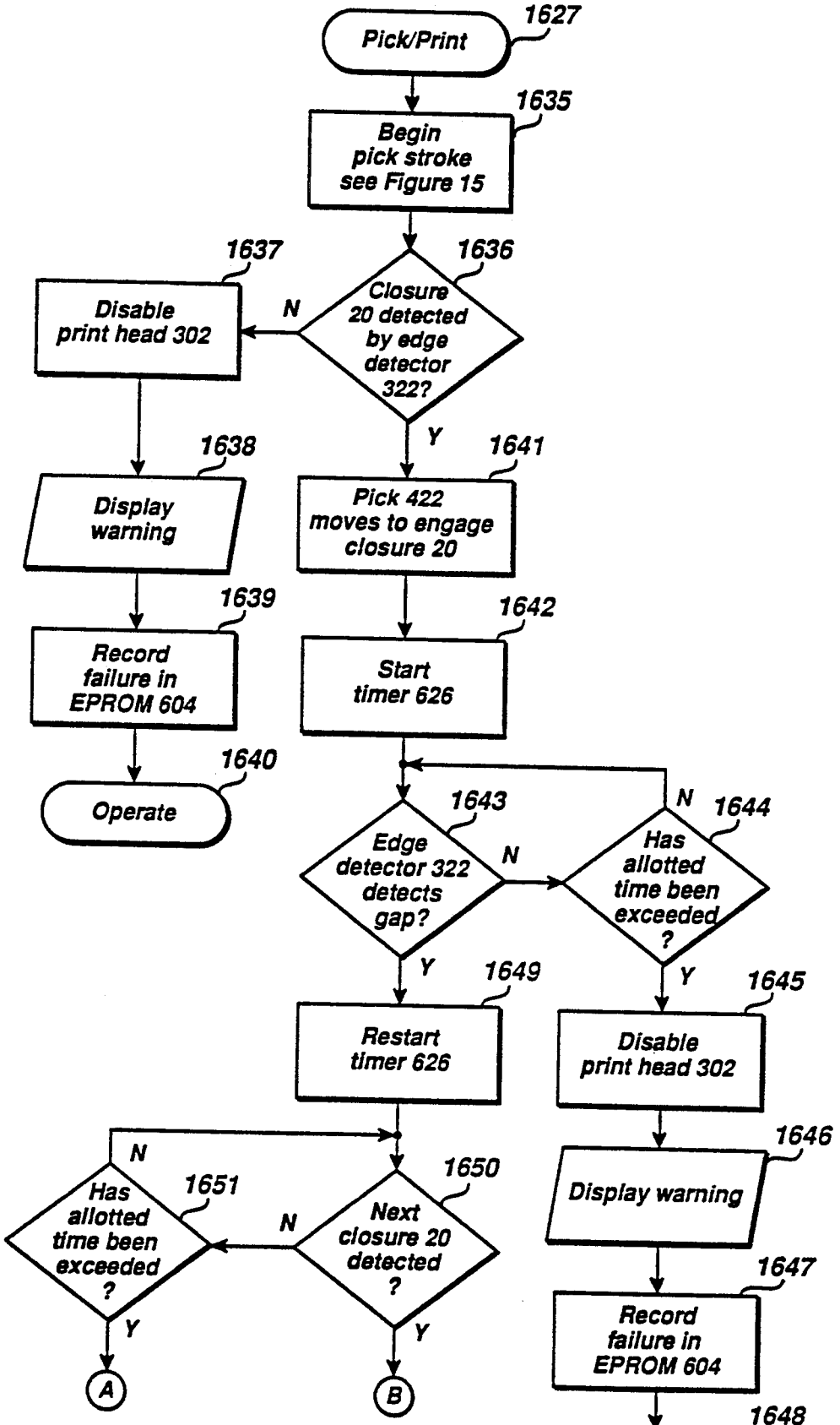
Figure 16 (cont. 3)

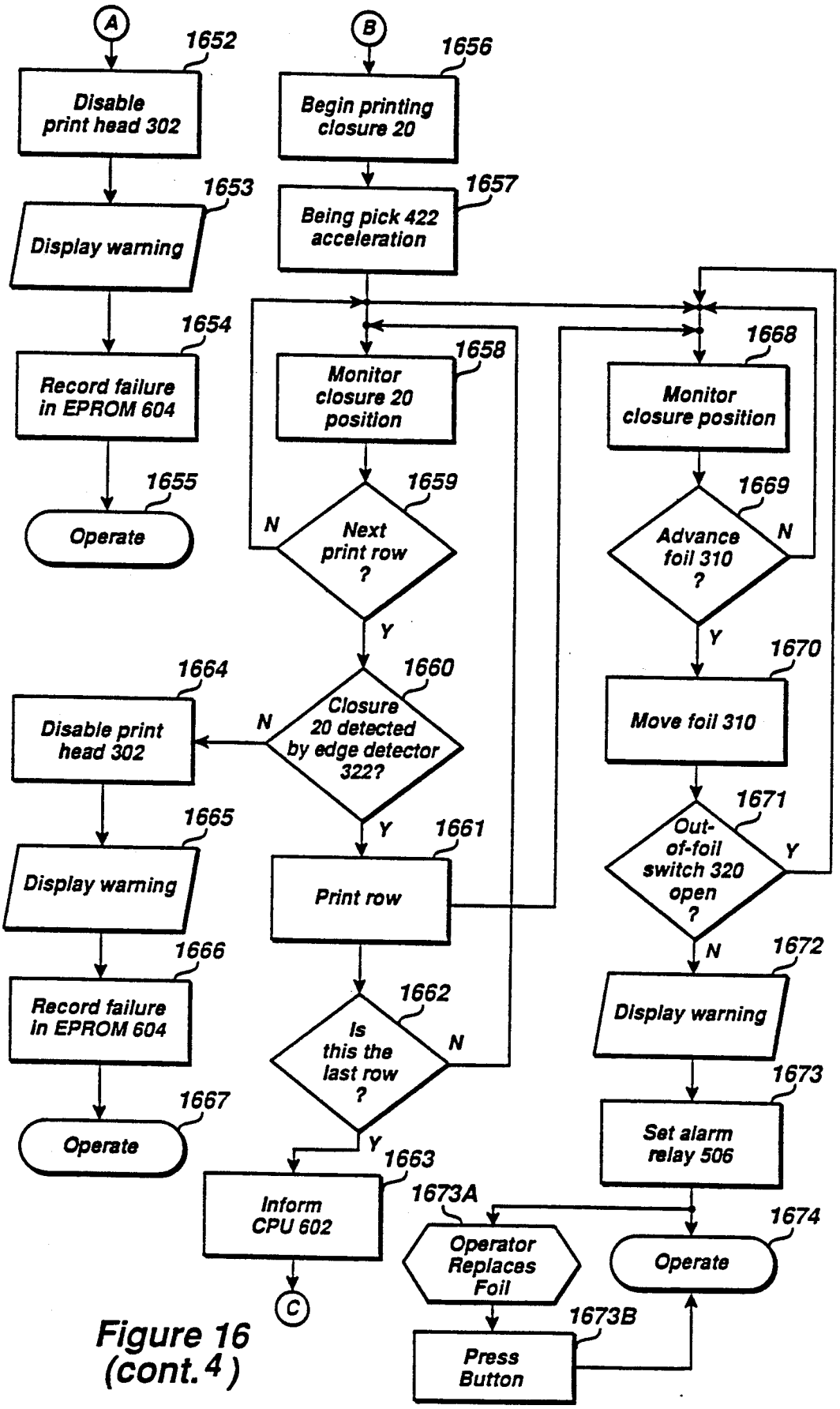
Figure 16 (cont. 4)

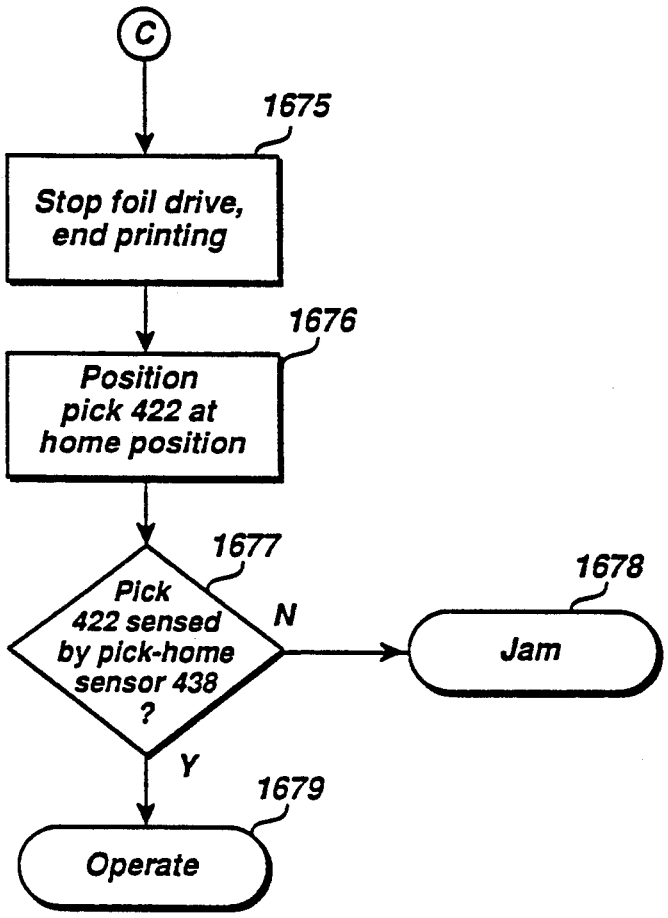
Figure 16 (cont. 5)

SYSTEM FOR MARKING AND INSTALLING CLOSURES

DESCRIPTION

Technical Field

This invention relates to automated bag closers. More specifically, it relates to an improved bag closing system which marks closures, applies the closures to bags, detects operating faults, and provides for data output capabilities, remote data communications, and operation by a host computer.

Background of the Invention

Many products are packaged in bags, usually of transparent plastic, closed by devices that can be easily removed and reinstalled. This packaging scheme not only retains the products within the bag, but is also convenient, improves the products, appearance, helps maintain freshness, and prevents external contaminants from contacting the products. Typical products so packaged include carrots, potatoes, apples, outer bags of milk, and loaves of bread.

While various devices are available to close the bags, two are widely used with mechanical bag closers: the wire wrapping tie and the flat plastic closure. However, the use of flat plastic closures is advantageous when printed information, such as price or coding date, is to be provided since the information can be printed on the closure. Closures, such as those discussed in U.S. Pat. No. 4,333,566, are available in various sizes and with various features.

Bags can be closed with closures applied by hand, by semi-automatic equipment, or by fully automated bag closers. Fully automated closers are advantageous since they can reduce the unit cost of closing a bag, can close bags faster, with improved uniformity, and they eliminate the dull and repetitive work of manually closing bags.

Prior art automated closers are typically located alongside conveyor belts which move product-filled bags toward the closers. The closers are loaded with a spool of closures connected chain-like by thin strips of material, called "webs." The end of the bag to be closed contacts a bag guide which directs the end into the closer. The closer has a closing roll with a high-friction surface, usually rubber, which rotates and a pressure arm which rides above the closing roll. As the bag passes along the bag guide it contacts the closing roll, is pinched between the closing roll and a pressure arm, and is forced into a mechanically pre-located closure. The closer senses entry of the bag into the closer and frees the now loaded bag closure from its neighbor by breaking its webs. A closure pick then causes another closure to be located to receive the next bag. If the closure is to provide information, typically a printer prints the information on another closure after the closure is located to receive the next bag. In prior art closers, a single-drive motor was used to operate the closing roll, closure pick, and the mechanism which breaks the webs.

While prior art automated closers have been successful, their limitations are apparent. Since only a single-drive motor is used, the time between closing a bag until another bag can be closed, called the "recycle time," is relatively long. This is because a single clutch is required to control interaction between the closing roll, closure pick, and the mechanism which breaks the webs.

Another problem with the relatively long recycle time of prior art closers is that it limits the number of bags that can be closed per unit time. To increase the closing rate in prior art closers, it is necessary to operate the drive motor at a higher speed, which exacerbates wear. Additionally, a higher drive motor speed forces the closing roll to rotate unduly fast, leading to friction burning of bags entering the closing roll. While gear changes may reduce the closing roll velocity, it limits the width of the bag closable. A closer geared to close a specific narrow bag would not completely close wider bags since the freeing of the "loaded" closure could be premature. Thus, in prior art closers gear changes are required with different bag sizes.

Prior art closers also lacked the ability to detect operational faults. A relatively frequent fault is when a foreign object, such as a bread heel, jams into the bag guide and prevents subsequent bags from being closed. Another fault is when a bag is improperly closed because a portion of the bag protrudes from the closure. As the bag is handled, the bag may open and its contents may spill out. Another fault occurs after the last closure on the spool has already passed the closure pick. When this happens, the closure pick will not move a closure into position for the next bag to be closed. Hence bags can pass unclosed, allowing the product fall out. A short comping of prior art closers is their lack of data collection capability. Since closers are typically at the end of an assembly line, they are located at a particularly useful data collection point. The rate of product output from the assembly line, the number of units closed per day or per work shift, or the number of units ready for shipment are beneficially determined at the closer.

Still another short coming of prior art closers is that they cannot communicate data to remote locations, such as a managers office. Ideally, data about the production rates, bag widths being closed, information printed on the closures, and any fault conditions, as well as start-up and shutdown of the closer, could all be controlled or sensed at a remote location. Additionally, it would be beneficial if closer operation and information printed on the closure could be controlled by a remote computer.

In the prior art, the closures are printed in several ways. Ink is frequently used, both in ink jet and flexible type printers. Since the rate at which closures must be marked is high, a fast-drying ink is required. These inks tend to quickly dry out on ink felts and to clog ink jets, resulting in frequent maintenance. Another prior art closure printer is the thermal transfer printer. However, these printers are too slow. Finally, in the prior art, closures have been printed with cold foil die impact printers.

A cold foil die impact printer uses a die, typically steel, and a special mylar foil covered on one side with an opaque, chalky material. In operation, the foil, supplied on a spool similar to an ink ribbon, is threaded between a closure backed by a hard surface and the die. When the die head is driven with high impact force into the foil, the foil drives into the closure and transfers material to the closure, leaving a mark on the closure in the shape of the die. While cold foil die impact printers have been successful, they require an operator to manually change dies to change markings.

Dot matrix wire impact printers have not been used in the prior art to mark plastic closures. A dot matrix wire impact printer used with an ink ribbon suffers from ink dry-out, as do other ink ribbon printers. Another reason they have not been used is that they typically have movable print heads that sweep across stationary surfaces This would be difficult to accomplish with high-speed closers because of the inertia that high speed print movements, would have to overcome before printing could be completed. Moving the closures past a fixed print head was not feasible in prior art closers because the complex mechanical interactions required. Compared with thermal printers, dot matrix wire impact printers are more reliable because they do not require physical contact with the plastic closure. Because the closures can bow uncontrollably, it would be more difficult to accurately control the contact of the thermal print head with the closure. While a cold foil ribbon would eliminate the ink dry-out, the transfer of cold foil markings to a closure, made from high-impact polystyrene, requires high-impact force and special foil qualities which has been difficult to reliably achieve. However, dot matrix printers are advantageous since they can produce different markings under the control of a computer.

It is clear that there has existed a need for a closer that is capable of high-speed operation using prior art closures without burning of the bags due to friction; that reduces the recycle time; that permits bags of various widths to be closed without gear changes; that provides for fault detection of improperly closed bags, jams, broken or missing closures, and excessive bag width; that has data collection capability; and that can bi-directionally communicate with a remote location. There has also been a need for a high-speed printer that does not require mechanical changes to change the closure markings; that does not use ink; that requires low maintenance; that has easily cleaned print heads; that displays what is being printed; that has programmable printing; and that can store information to be printed on a closure.

SUMMARY OF THE INVENTION

It is an object of the present invention to provide a closer which reduces friction burning of bags.

It is another object of the present invention to provide a bag closer with reduced recycle time, hence improved overall speed.

It is another object of the present invention to provide a closer capable of automatic bag width detection.

It is another object of the present invention to provide a closer which can efficiently close various bag widths without physical alteration of the closer.

It is another object of the present invention to provide a bag closer which detects jams.

It is another object of the present invention to provide a bag closer which detects improperly closed bags.

It is another object of the present invention to provide a bag closer which checks for improper bag widths.

It is another object of the present invention to provide a bag closer which provides a warning when a fault occurs.

It is another object of the present invention to provide a bag closer which operates a customer supplied warning indicator when a fault occurs.

It is another object of the present invention to provide a bag closer which is able to collect production data.

It is another object of the present invention to provide a bag closer which enables remote computer control of the closer and printer.

It is another object of the present invention to provide a bag closer which enables remote data communications.

It is another object of the present invention to provide a dot matrix printer for marking closures.

It is another object of the present invention to provide a programmable dot matrix printer for printing on closures.

It is another object of the present invention to provide a cold foil dot matrix wire impact printer for marking closures.

It is another object of the present invention to provide a system which provides for changing the markings on a closure without mechanical changes to the printer.

It is another object of the present invention to provide a display which indicates what is printed on a closure.

These and other objects, which will become apparent as the invention is more fully described below, are obtained by providing a method and apparatus for marking a closure and an apparatus for automatically closing a bag with the closures. The closer is comprised of: a closing roll; a pick; and a closure break-off device, wherein the operation of the closing roll, pick, and break-off device are electronically controlled. Preferably, the closing roll, pick, and break-off device operate under the direction of a central processing unit. In the preferred apparatus, the closing roll, pick, and break-off device are driven by separate stepper motors under the control of microcontrollers that are directed to operate by the central processing unit, read only memory that stores the closer operating program, a display that indicates the system status, fault detection sensors for detecting if the closed bag is properly closed or if a jam has occurred, and an apparatus which bi-directionally communicates with a remote processing unit.

The printer is comprised of a stationary dot matrix impact print head, a cold-foil ribbon for printing, and a mechanism for sweeping closures past the print head in a controlled manner. Preferably, the foil is advanced only as required to provide fresh foil between the print head and closure. The foil mechanism and the mechanism for sweeping the closures is controlled by a digital processing unit. An out-of-foil detector and a closure sensor prevent printing without foil and a closure in front of the print head.

The method of printing a message with a dot matrix impact printer includes the steps of mounting the print head in a fixed position, moving closures at a known rate past the print head, locating a cold-foil ribbon between the print head and the closure, and driving the print head impact wires into the closure whereby material from the cold-foil ribbon is transferred to the closure. Preferably the method includes decoding the message to determine which impact wires are to be driven, and wherein the driving of the impact wires is synchronized with the moving of the closures.

DETAILED DESCRIPTION OF THE INVENTION

Figure 1:
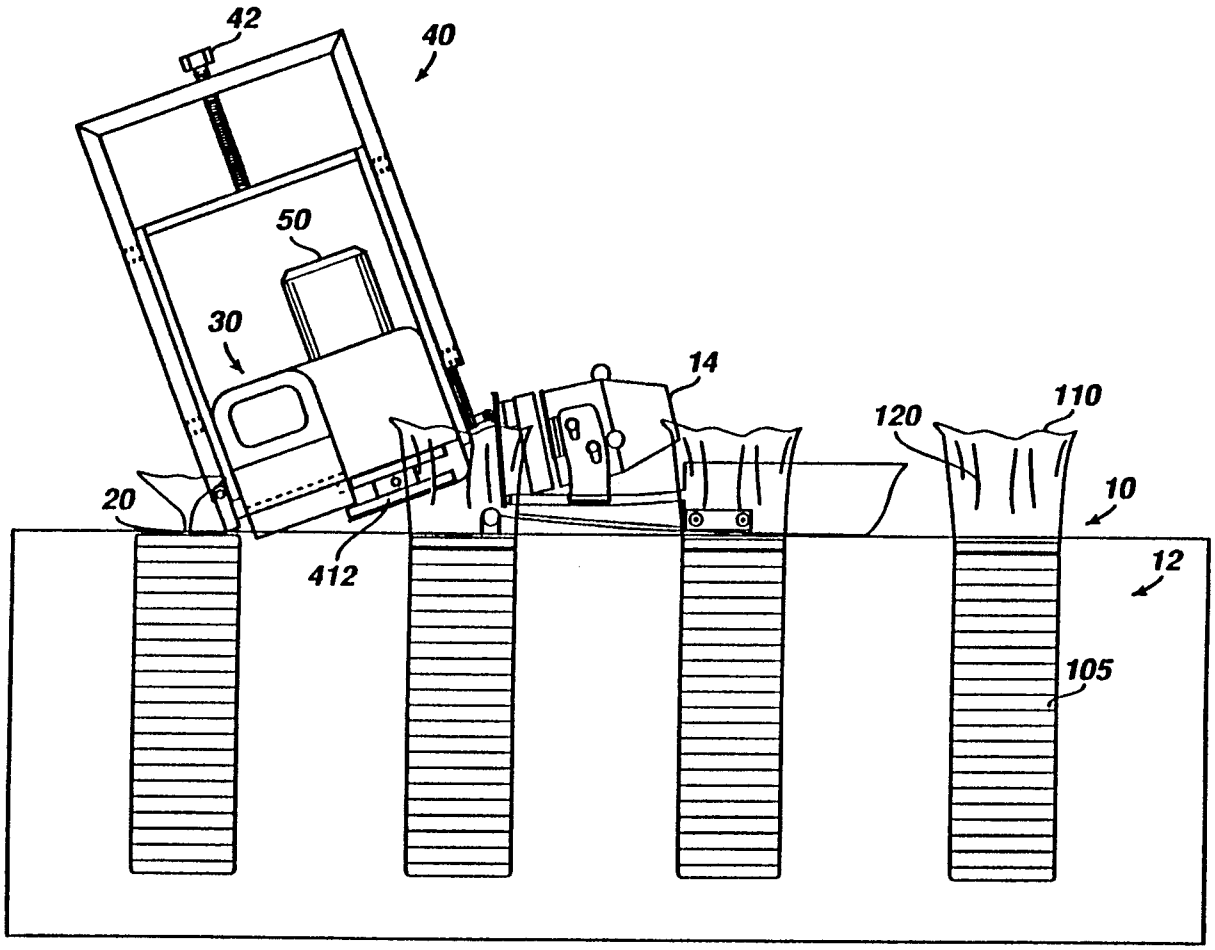
FIG. 1 is an operational view of a bag closing system according to the preferred embodiment.

The preferred embodiment closure marking and bag closing system is shown in operation in FIG. 1. Each bag 10 on a conveyor belt 12 will be closed with a closure 20. These closures 20 are printed by a printer 30 prior to being applied by a closer 40. Typically, a brush roller 14 causes the bags 10 to lay without kinks or folds before entering the closer 40. The in and out position of the closer 40 is adjustable by a screw arm 42 to the proper position. A power supply unit 50 supplies operating power for the printer 30 and the closer 40. To assist understanding of the preferred embodiment system, sections of the bag 10 will be preceded by a 1 and sections of the closure 20 will be preceded by a 2. Following this scheme, components of the printer 30, the closer 40, and the power supply unit 50 will be preceded by a 3, a 4, and a 5, respectively. Finally, components of a display/CPU assembly 60, shown in FIG. 2A, will be preceded by a 6.

Figure 2A:
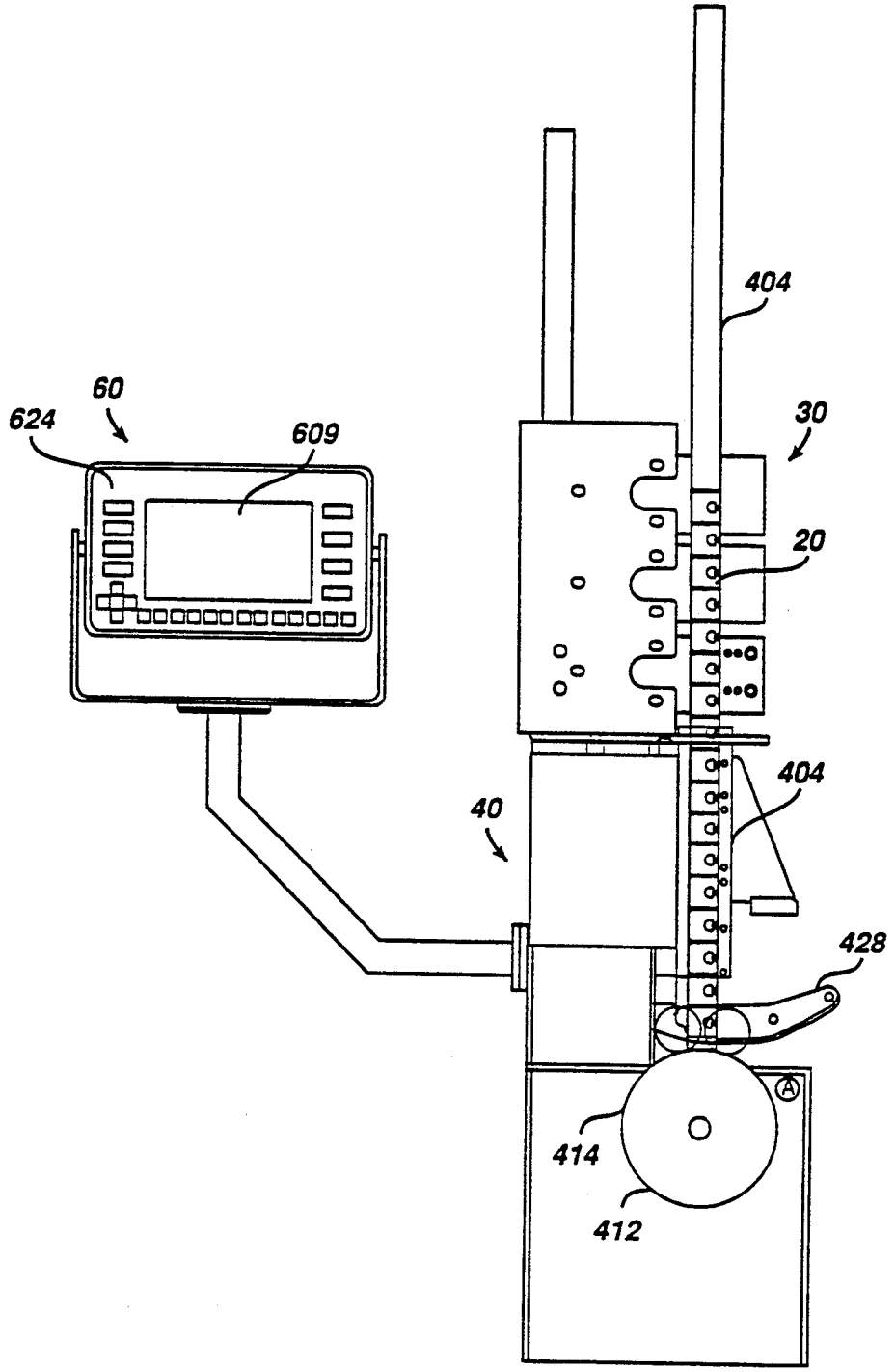
FIG. 2A is a front view of a closer and a printer according to their preferred embodiments.
Figure 2B:
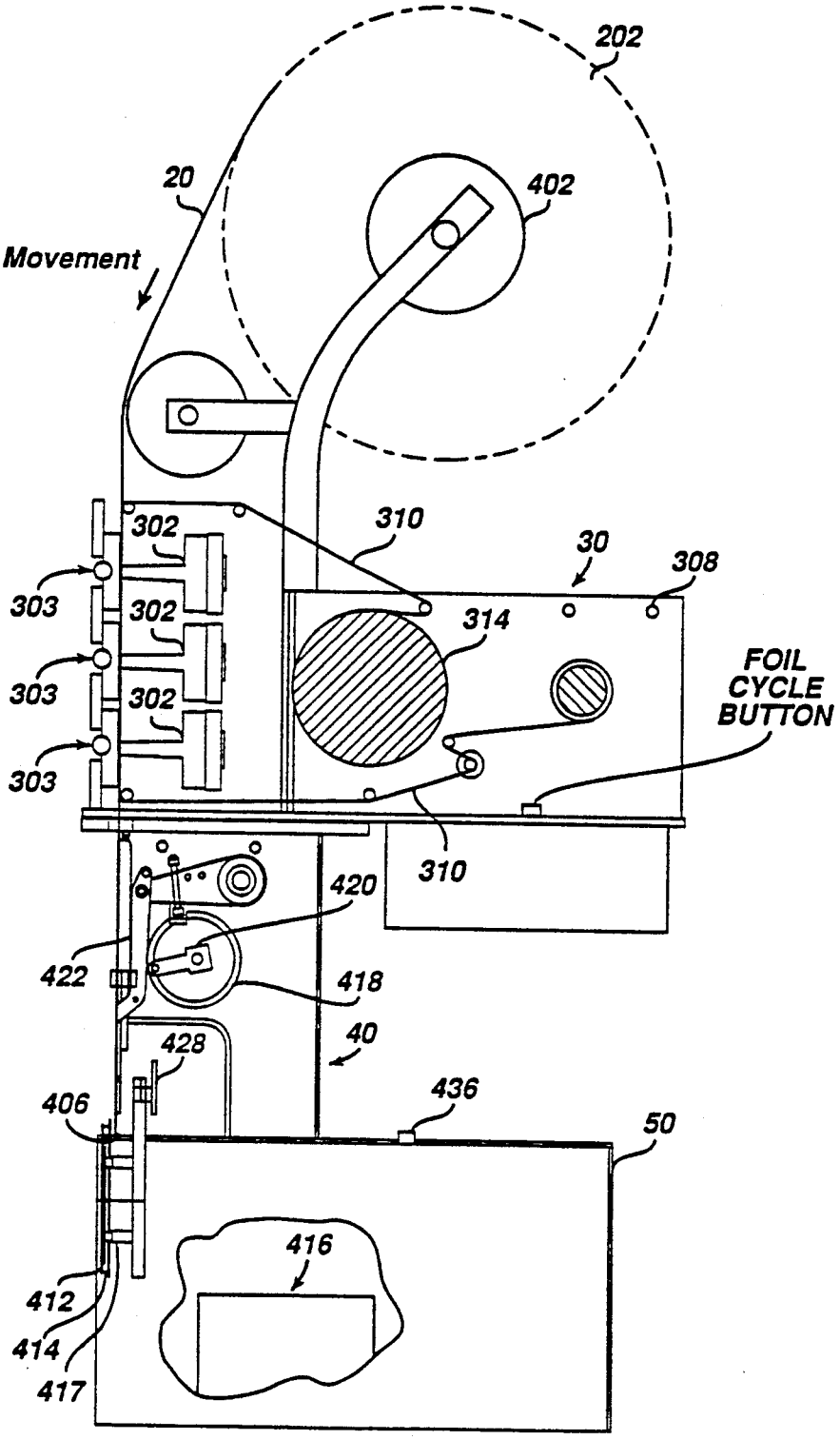
FIG. 2B is a right side view of the closer and the printer shown in FIG. 2A.
Figure 3:
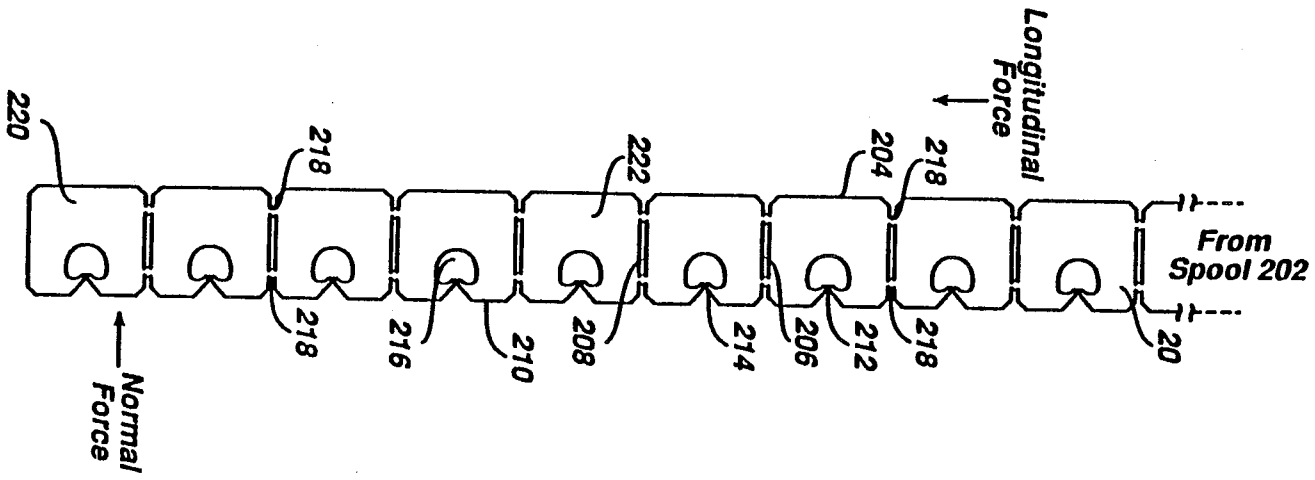
FIG. 3 is a pictorial view of interconnected closures as supplied on a spool.

Referring still to FIG. 1, the bags 10 are pre-filled with a product 105, typically bread. The bags 10 have a front edge 110 and a neck portion 120 that are orientated toward the closer 40. The closures 20 that close the bags 10 typically are stamped out of high-impact polystyrene and come on a spool 202 that is mounted on a reel 402 as shown on FIG. 2B. Referring now to FIG. 3, the closures 20 each have a back edge 204; a top side 206; a bottom side 208; a front edge 210; and an opening 212, which leads via a channel 214 into a hole 216. In the preferred system, the openings 212 face the bag 10 as it approaches the closer 40. The bottom side 208 is the side furthest from the spool 202. Individual closures 20 are connected via webs 218 to its neighboring closures 20, except for the last closure 20, specially designated the end closure 220, which only has one neighbor.

Still referring to FIGS. 3, the webs 218 are designed so that a force normal or transverse to the front edge 210 of the end closure 220 will separate it from its neighboring closure 20, provided that the neighboring closure 20 is held stationary. Referring now to FIGS. 2B and 3, the webs 218 are also designed so that a longitudinal force on the top side 206 of a closure 20, directed toward the end closure 220, will pull closures 20 from the spool 202 and also push the end closure 220 down. In operation, during the cycle that the bag 10 is inserted into the end closure 220 that end closure 220 is separated from its neighbor closure 20, another closure 20 is printed, as yet another closure 20 has longitudinal force applied to it. As operation of the closer 40 continues, individual closures 20 cycle through printing, receiving the longitudinal force, and closing a bag 10.

Figure 4:
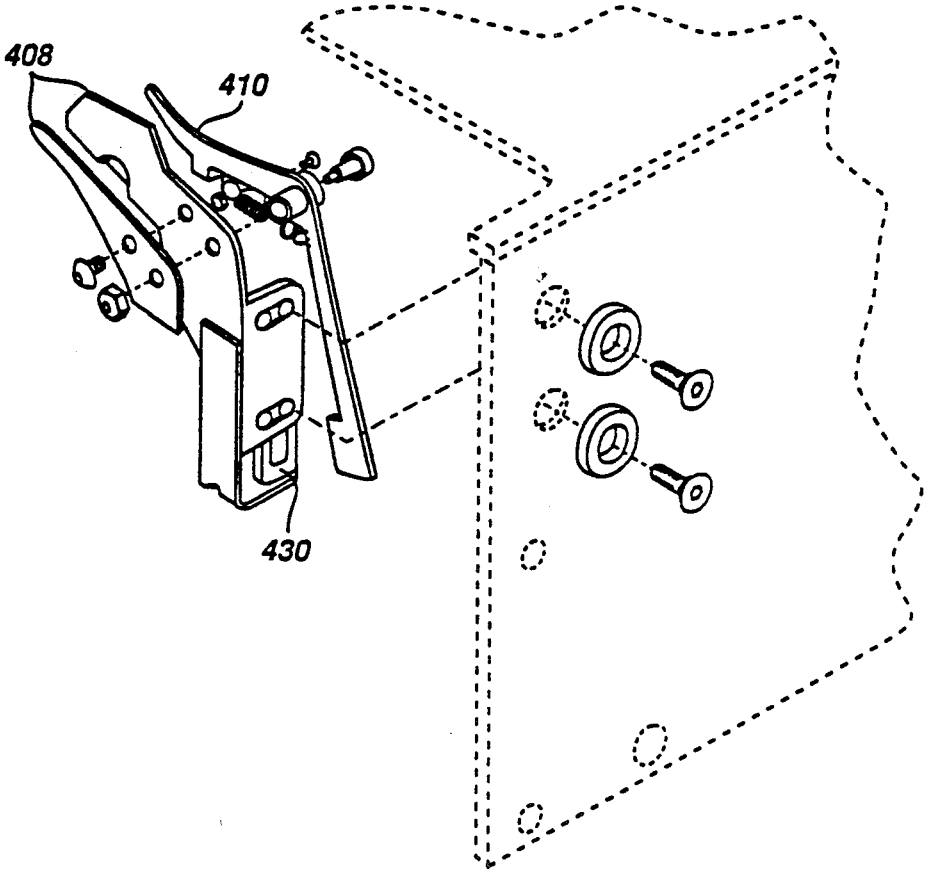
FIG. 4 is an exploded view of the bag guide assembly, the lever arm, and the lever sensor of the preferred embodiment closer.
Figure 5:
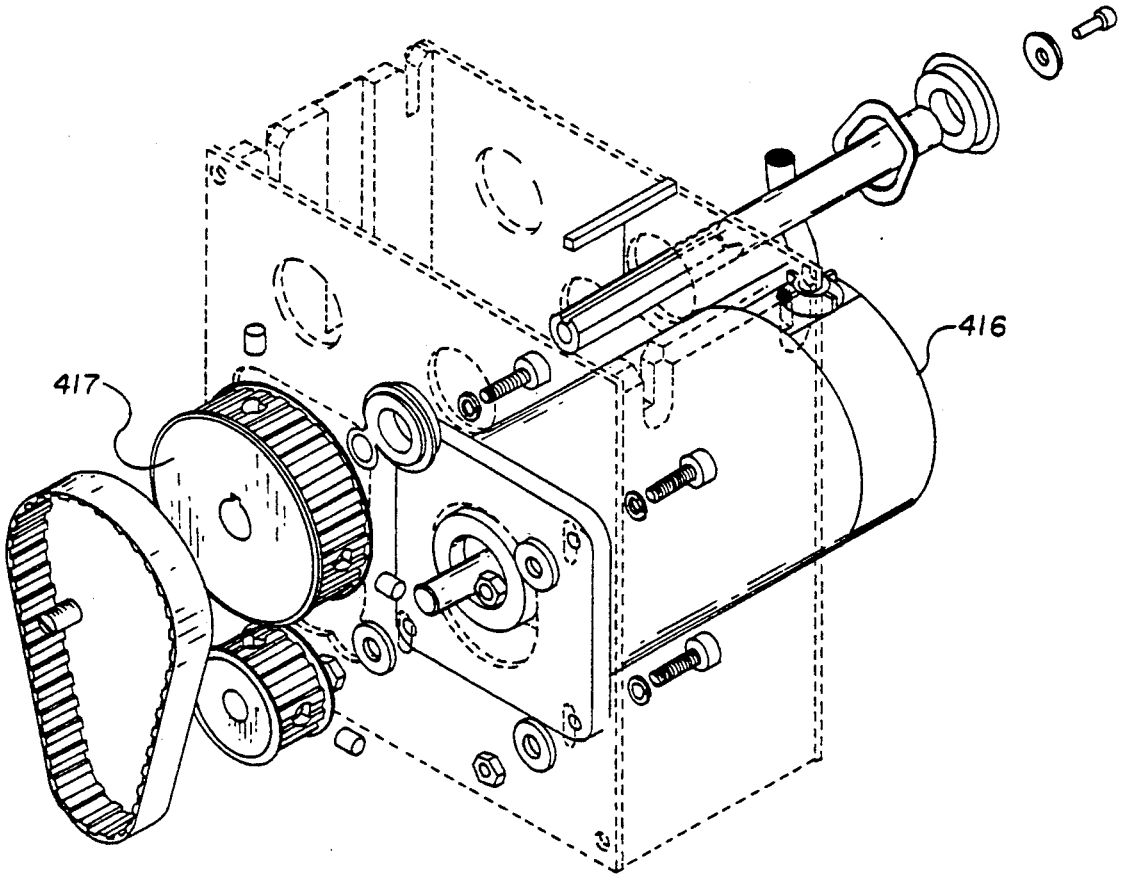
FIG. 5 is an exploded view of the closing roll drive assembly of the preferred embodiment closer.
Figure 9:
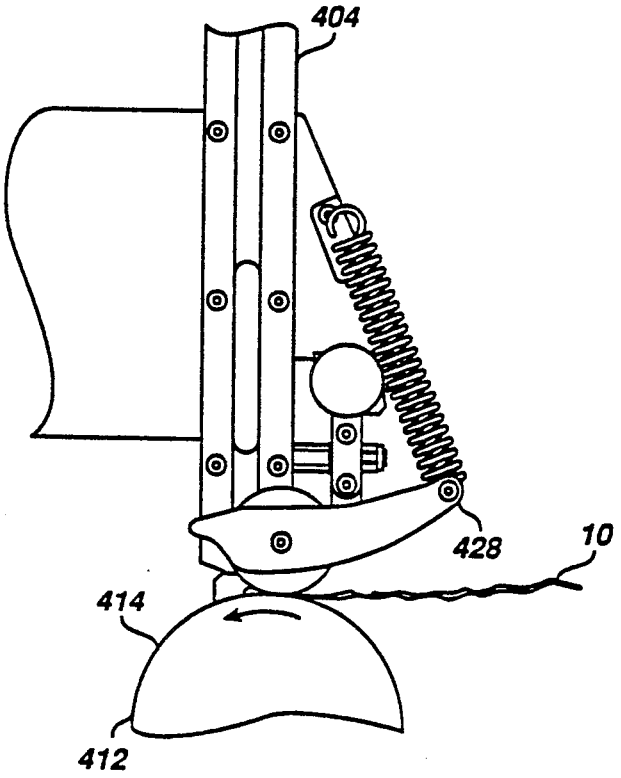
FIG. 9 is an operational view depicting a bag entering the preferred embodiment closer.

Referring now to FIG. 2B, the spool 202 is located above the printer 30. The closures 20 are arranged so that as they are pulled from the spool 202, they pass between print heads 302 and anvils 303, into a closer guide 404 (shown in FIG. 2A) and the end closure 220 is pushed to an end closure position 406. Referring now to FIGS. 2A and 4, a bag guide assembly 408 and a lever arm 410 are mounted at the location labeled A. The closer 40 also has, as shown in FIGS. 2A, 2B and 9, a closing roll 412 with a high friction roll surface 414 having a pressure roll assembly 428 atop it. A closing roll stepper motor 416, and associated components as shown in FIG. 5, drives a closer gear 417 to which the closing roll 412 (not shown in FIG. 5) is directly attached.

Figure 6:
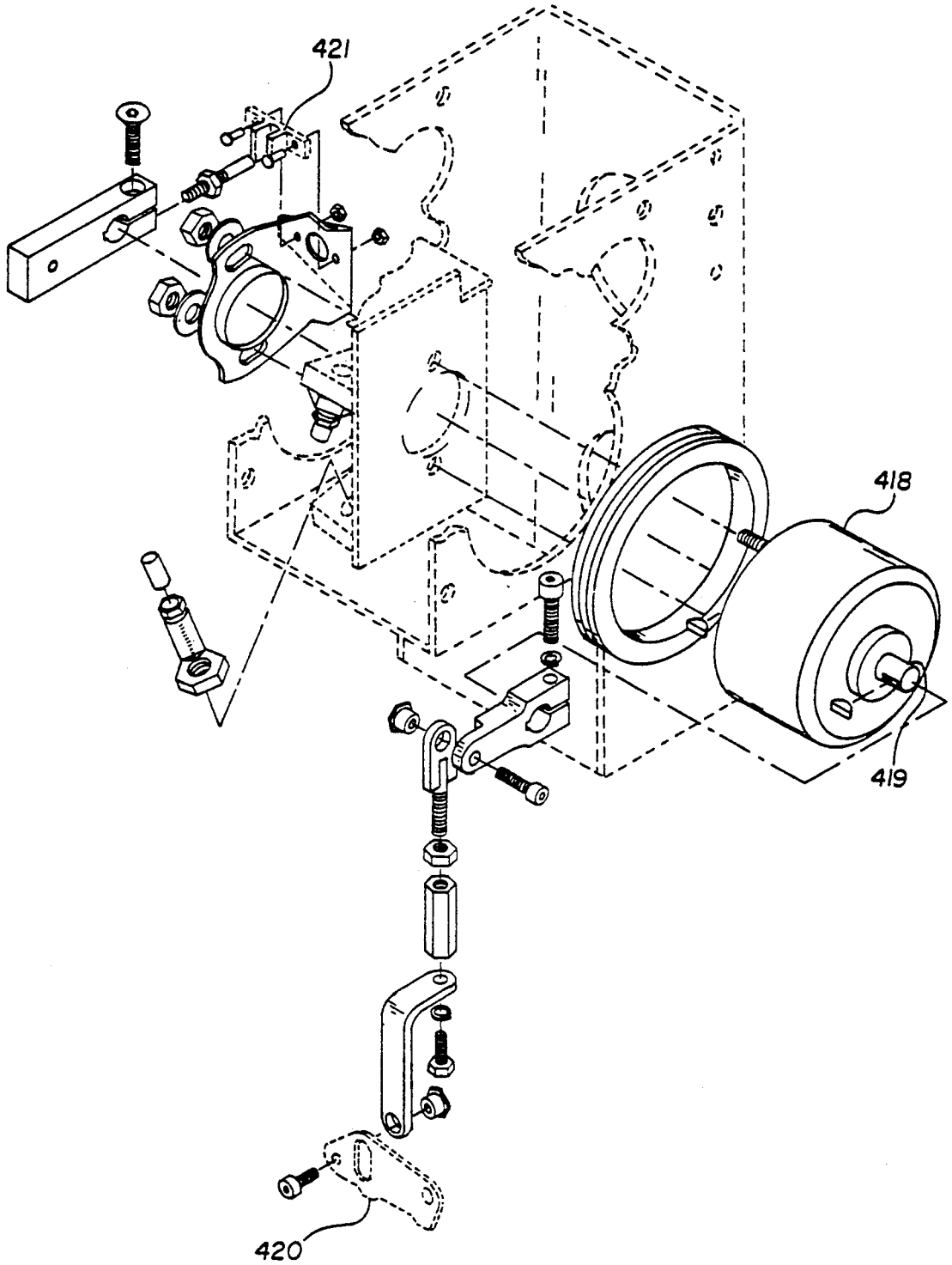
FIG. 6 is an exploded view of the break-off assembly of the preferred embodiment closer.

As shown in FIG. 6, the closer 40 also has a break-off solenoid 418 with a shaft 419 connected, via a mechanical linkage, to a break-off lever 420. The shaft 419 passes through the break-off solenoid 418 and connects with other mechanical components coupled to a break-off sensor 421. The break-off lever 420, end closure 220, and closure guide 404 are arranged as shown in FIG. 8.

Figure 7A:
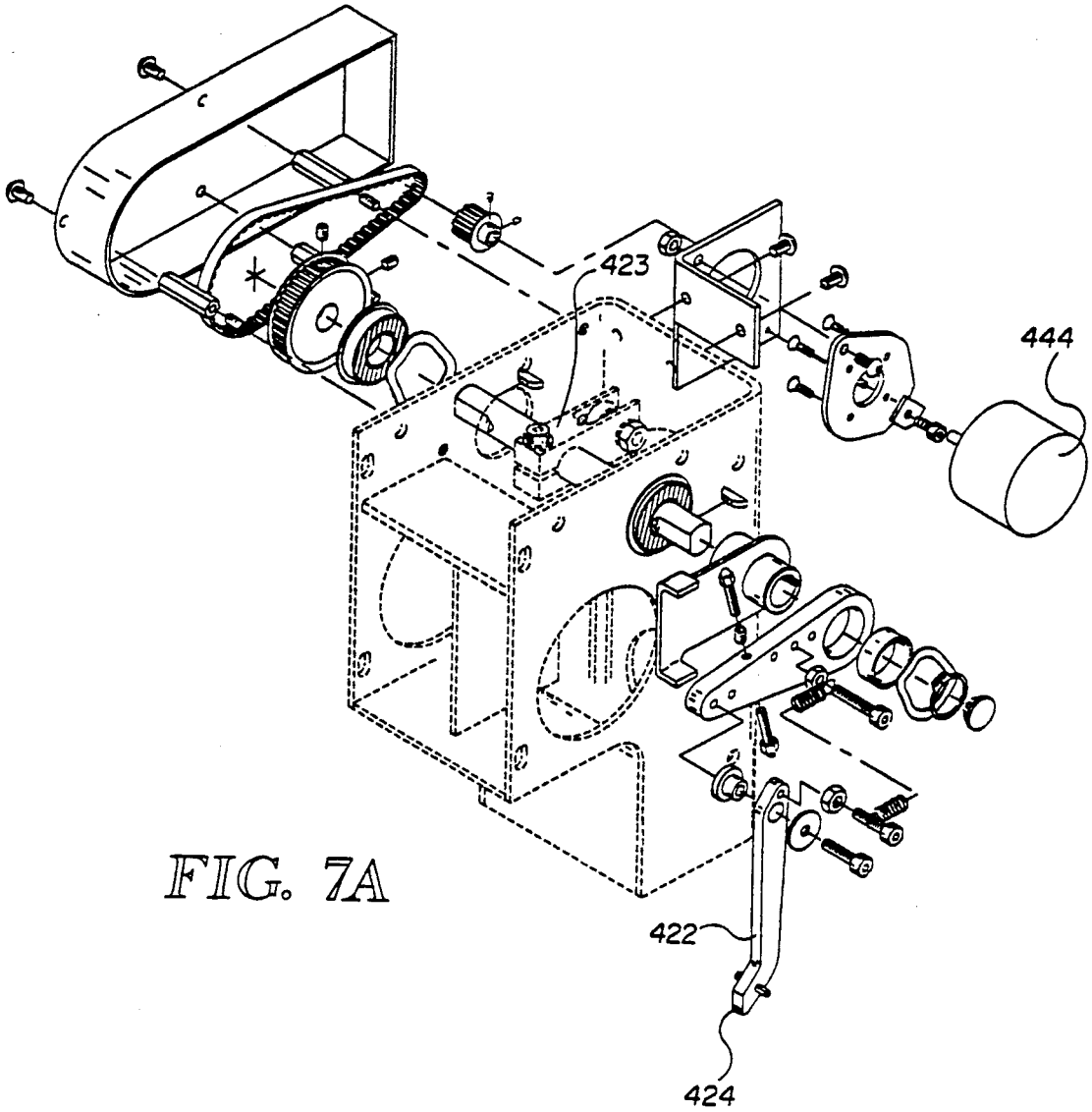
FIG. 7A is an exploded view of the pick arm and shaft assembly of the preferred embodiment closer.

As shown in FIG. 7A, the closer 40 also has a pick 422 with a contact surface 424. The pick 422 is driven by a pick stepper motor 426 connected to it via a coupler 423 and various gears, belts, and linkages as shown in FIGS. 7A, and 7B.

Figure 7B:
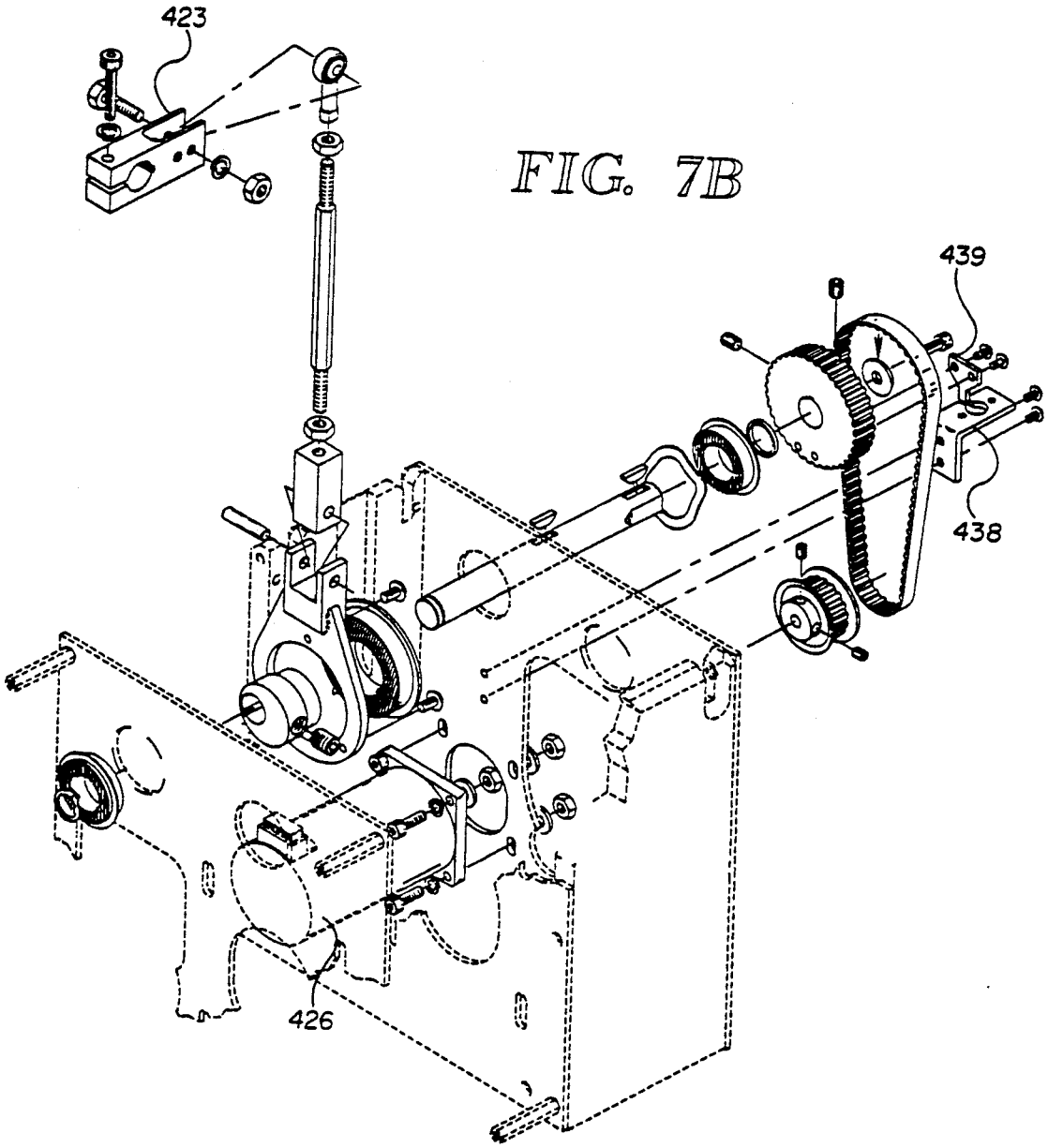
FIG. 7B is an exploded view of the pick drive assembly of the preferred embodiment closer.
Figure 8:
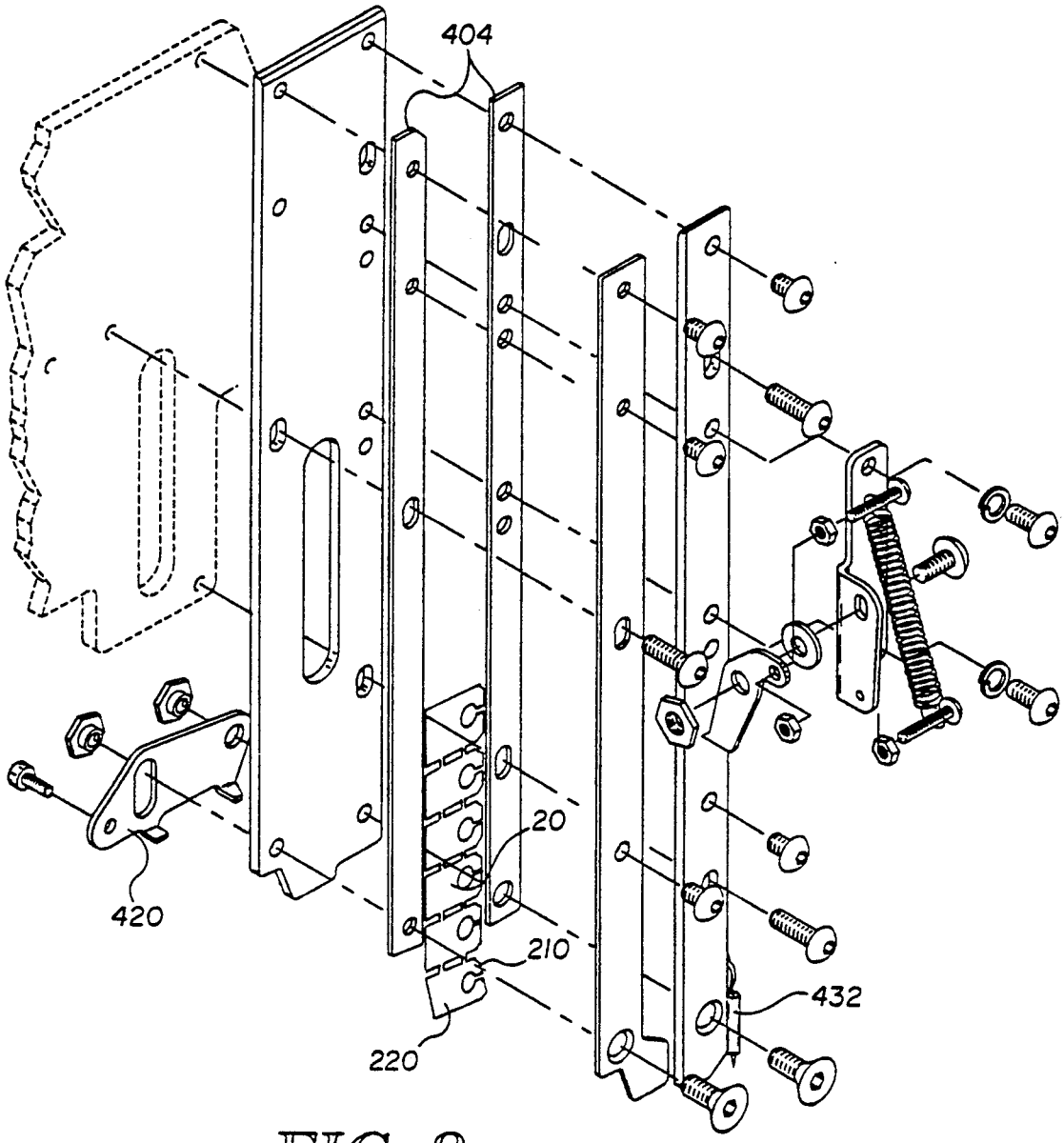
FIG. 8 is an exploded view illustrating the arrangement of the closure guide, the end closure, and the break-off solenoid operated lever.
Figure 10:
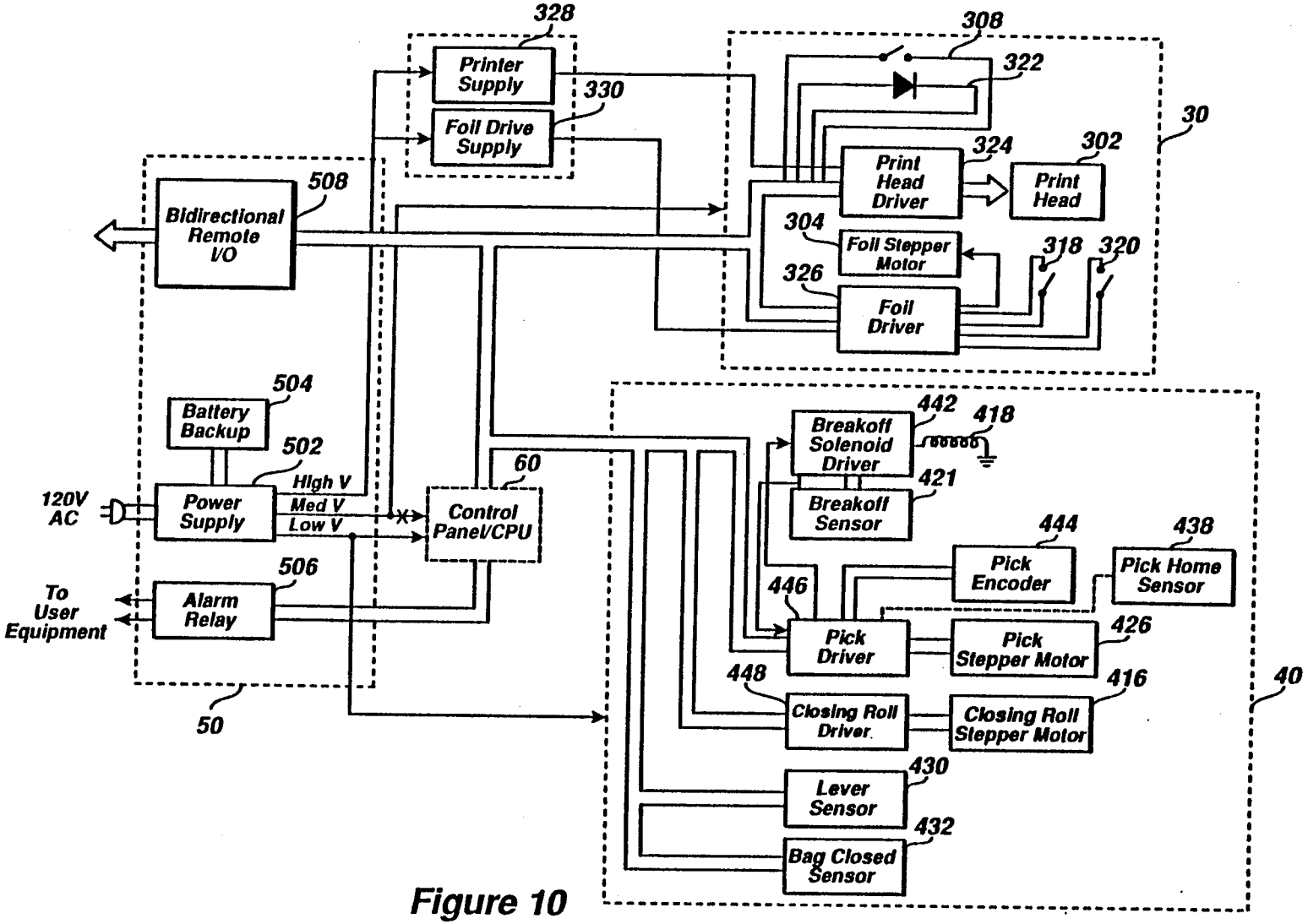
FIG. 10 is a schematic block diagram of the closer, the printer, the power supply unit and the control panel CPU assembly according to their preferred embodiments.

In addition to the previously mentioned break-off sensor 421, the closer 40 has several other electronic components including: a lever sensor 430, shown in FIG. 4; an opto-electronic bag closed sensor 432, shown in FIG. 8; a manual recycle button 436, as shown in FIG. 2B; an opto-electronic pick home sensor 438 which senses the presence of a vane 439, shown in FIG. 7B; and an optical pick encoder 444, shown in FIG. 7A. Additionally, the closer 40 has several drivers, particularly: a break-off solenoid driver 442 for actuating the break-off solenoid 418; a pick driver 446 for driving and controlling the pick stepper motor 426; and a closing roll driver 448 for driving and controlling the closing roll stepper motor 416. These drivers are electronic circuit boards that control the movements and timing of the mechanical parts within the closer 40. These drives, as well as their electronic interconnections with other electrical or electro-mechanical components are shown in FIG. 10.

The break-off solenoid driver 442 is a simple complementary-pair bipolar transistor driver capable of driving the break-off solenoid 418 with the required power, 48 VDC at 3 amperes, when directed by the pick driver 446. The pick driver 446 and the closing roll driver 448 are identical.

Figure 11:
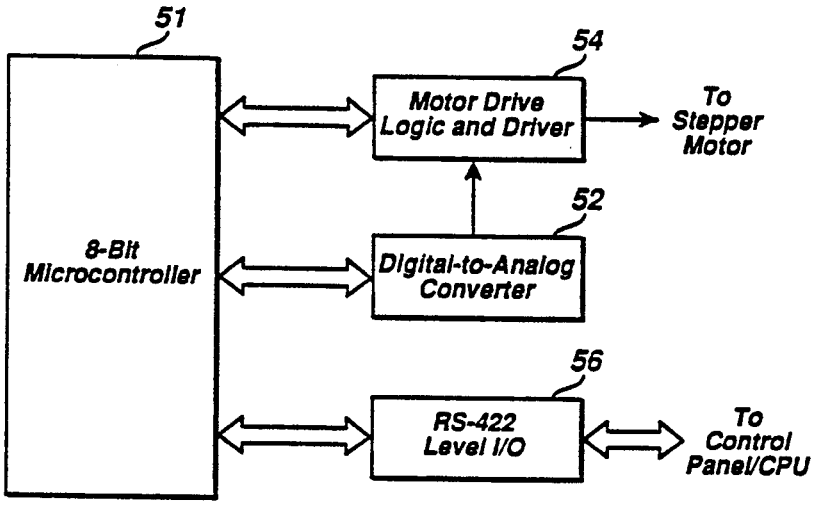
FIG. 11 is a block diagram of the preferred embodiment stepper motor drivers.

The pick driver 446 and closing roll driver 448 organization is illustrated in FIG. 11. The above-mentioned numbering scheme is not applicable since a similar driver, the foil driver 326, is used in the printer 30. Each of these drivers has an 8-bit microcontroller, MCU 51, that includes: 4K of electrically programmable memory; 128 bytes of random access memory; and two on-board timers. The programmable memory is programmed with an executable program designed to permit micro-step control (see below) of the driver's associated stepper motor. In the preferred embodiment, MCU 51 is similar to the Intel 87C51 single-chip microcontroller, whose 1989 data sheet is hereby incorporated by reference. These drivers also have a digital-to-analog converter, D/A 52, used to limit motor current during micro-stepping. Micro-stepping is a method of operating a stepping motor in a controlled manner between the normal step locations and is explained in the SGS "Motion Control Application Manual," 1986, which is hereby incorporated by reference. Pages 39–51 are particularly helpful as an introduction to microstepper technology. These drivers have motor drive chips, MDC 54, similar to the SGS L6203, which decode the information from the MCU 51, and operate the driver's stepper motor. Finally, these drivers also provide for bi-directional RS-422 logic level communication, shown by I/O 56, with the control panel\CPU 60, subsequently described.

Figure 12A:
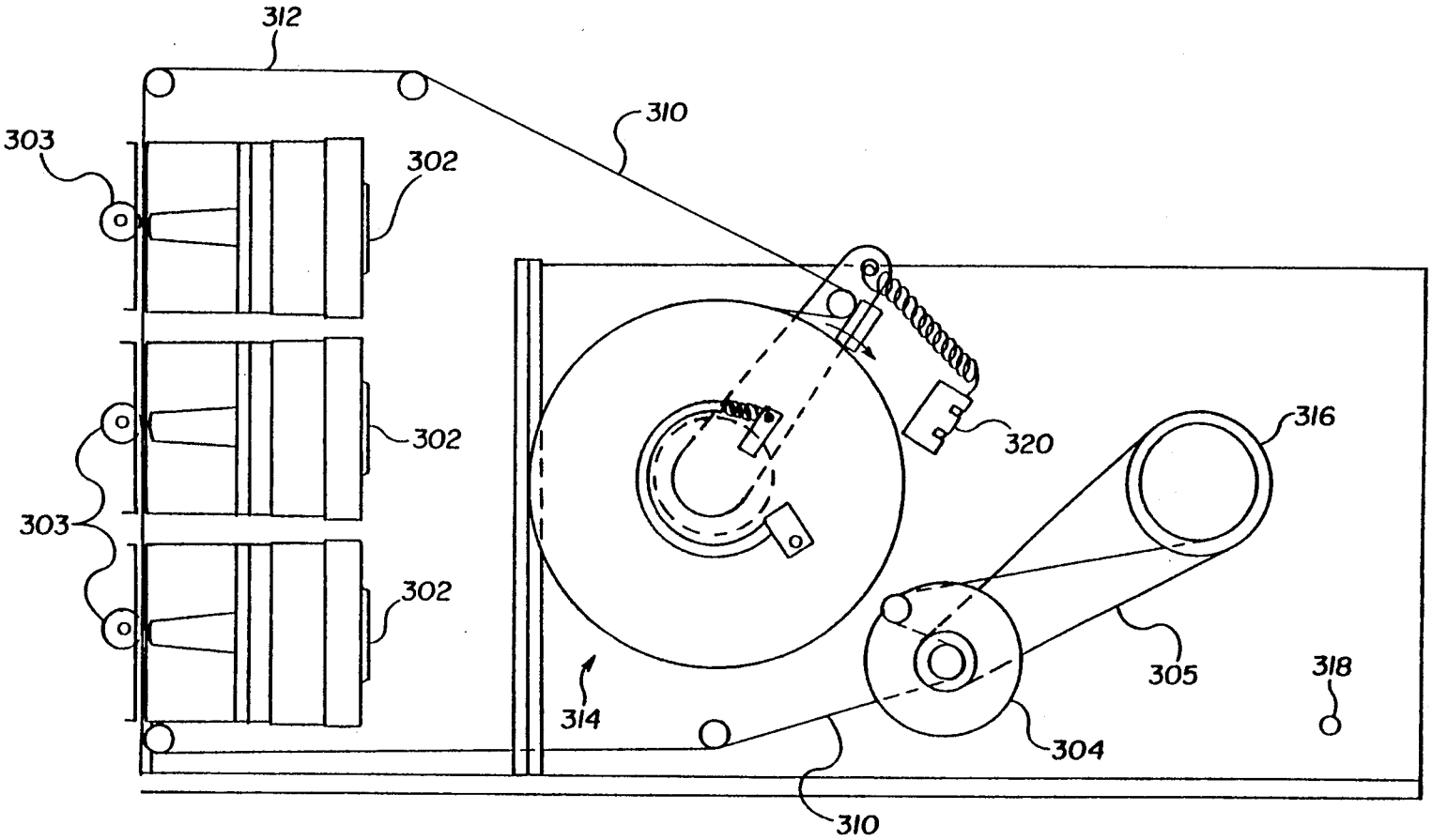
FIG. 12A is an elevational view of the preferred embodiment printer.
Figure 12B:
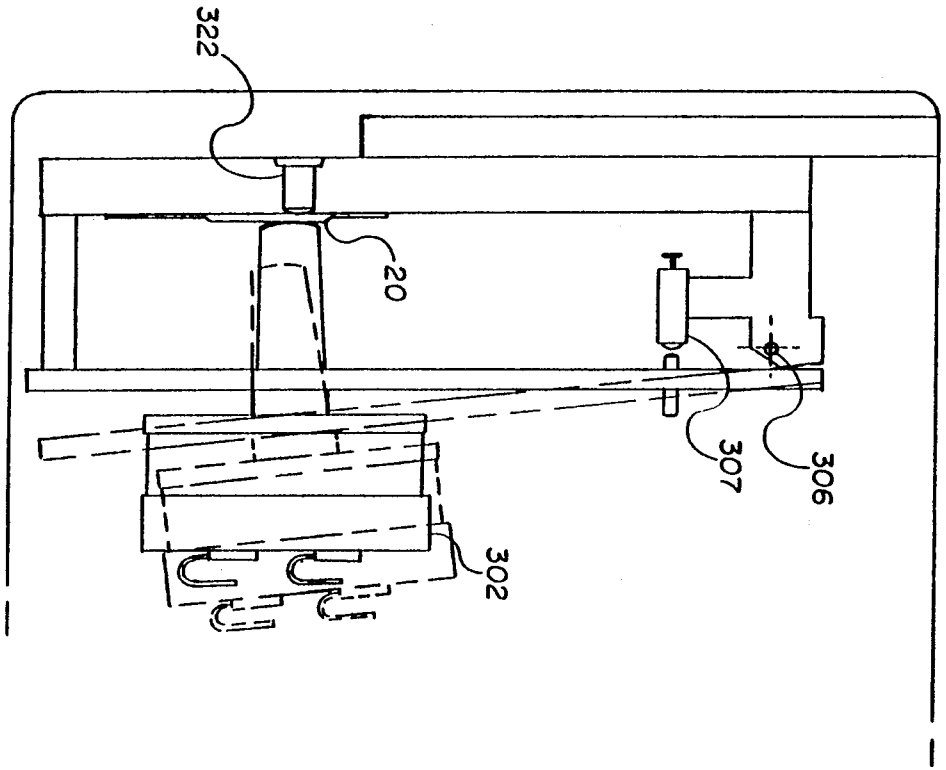
FIG. 12B is an illustration of the mounting method of the print heads and the edge detector used in the printer shown in FIG. 12A.
Figure 12C:
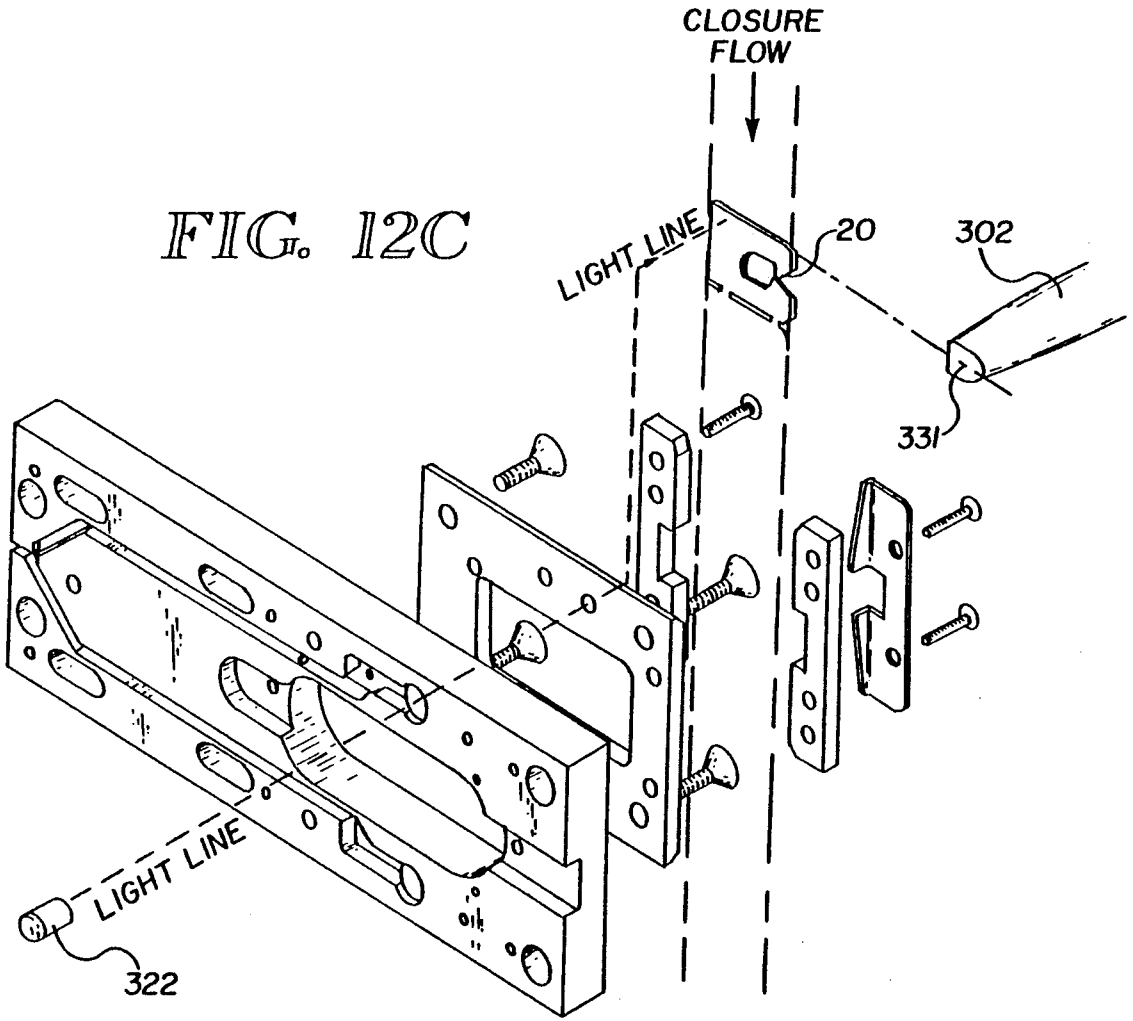
FIG. 12C is an exploded assembly view showing the relationship between the edge detector, closures, and the print head in the printer shown in FIG. 12A.

Referring now to FIGS. 2B, 12A and 12B as required, the printer 30 includes the print heads 302; the anvils 303; a foil stepper motor 304; a print head hinge 306; a hinge switch 307; foil 310 wrapped around a foil spool 314 and a take-up spool 316, and having marking material 312; a manual foil advance switch 318; and an out-of-foil switch 320. Additionally, as shown in FIGS. 12B and 12C, the printer 30 also has a opto-electronic edge detector 322. While not specifically shown, within the printer 30 are a print head driver 324, a foil driver 326, a printer power supply 328, and a foil driver power supply 330. The printer power supply 328 and the foil power supply 330 provide operating power for the printer 30, specifically 48 VDC, derived from input 300 VDC. These components are shown in the schematic diagram of FIG. 10.

In the preferred embodiment printer 30, the print heads 302 are of the dot matrix wire impact type and, in operation, are fixed in position. They have 18 heavy duty impact wires aligned in a row 331 shown in FIG. 12C. Each impact wire (not shown) is driven by a solenoid (also not shown) when that solenoid is actuated. The preferred print head 302 is a MAGNETEC model cc3739-111-18WIRE INLINE Printhead. When the print head 302, see FIG. 12A, prints on the closure 20, the anvils 303 prevent the closures 20 from moving away from the impact wires, allowing the impact wires to drive solidly into the closures 20. Preferably, the anvils 303 are cylindrical and rotate when the closures 20 move down. To ease replacement of the foil 310, and to assist cleaning, maintenance, and repair, the print heads 302 are mounted with a hinge 306 as shown in FIG. 12B. When operating, a clasp 333 keeps the print head 302 in position. Since a print head 302 could be damaged if operated without a closure 20, a hinge switch 307 prevents print head 302 operation if the print head 302 is open. The hinge switch 307 is a simple on-off switch that signals the print head driver (62) to remove power from the print head 302 and will not be subsequently discussed.

As indicated, the printer 30 uses foil 310 to mark the closures 20. The foil 310 is similar to cold-foils used with prior art cold foil die impact printers and is well known. However, indications are that the marking material 312 that is impact transferred to the closures 20 during printing is optimally a somewhat tackier and softer material than that used in the prior art. Additionally, because of the width of the preferred embodiment print head 302, a somewhat wider foil is required. While currently there is no optimized foil, the type CDF-62 cold-foil made by Coding Products, produces acceptable markings.

Referring now to FIG. 12A, the cold foil 310 is: wound around a foil spool 314; threaded between print heads 302 and closures 20 so that the material 312 is adjacent to the closures 20; and wound onto a take-up spool 316. The take-up spool 316 is also connected via a belt 305 to the foil stepper motor 304. As the foil stepper motor 304 rotates, the take-up spool 316 pulls foil 310 from the foil spool 314, moving the foil 310 across the print heads 302. Additionally, a magnetic out-of-foil switch 320 senses when the foil 310 is not properly suspended between the foil spool 314 and the take-up spool 316. A manual foil advance switch 318 is provided to permit an operator to manually advance the foil 310 and a door switch 308 prevents the printer 30 from operating if the clear plastic door (not shown) used to close the printer is open. The manual foil advance switch 318 and the door switch 308 are simple interlock devices and will not be discussed further.

Figure 13:
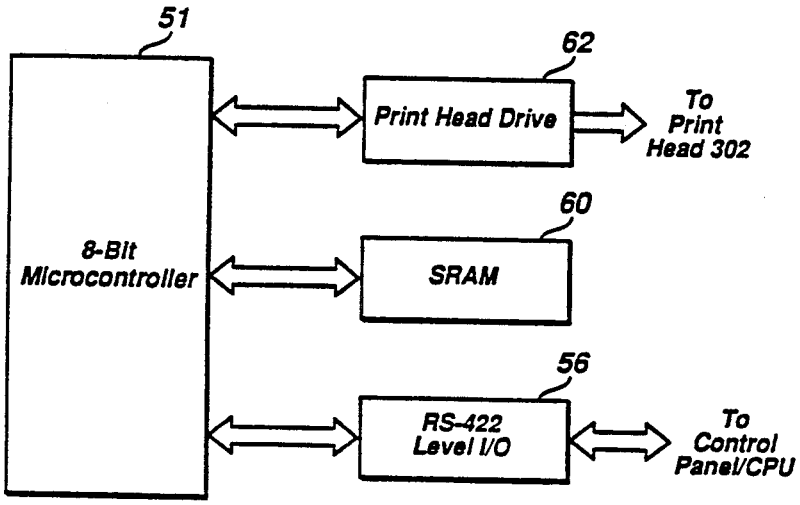
FIG. 13 is a block diagram of the preferred embodiment print head driver.

As indicated, the foil driver 326 is identical to the previously described drivers illustrated in FIG. 11. However, the print head driver 324 is somewhat different and reference should be made to FIG. 13. The print head driver 324 has the same MCU 51 and I/O 56 as the drivers illustrated in FIG. 11. However, the print head driver 324 does not have a D/A 52 or an MDC 54. Rather, the print head driver 324 includes 2K of static random access memory, shown as SRAM 60, and 18 complementary pairs of power MOSFETs, shown as wire drive 62. Each MOSFET pair operates a print head solenoid (not shown), which causes an impact wire to drive from the print head 302. The MCU 51 controls, with the assistance of the SRAM 60, which MOSFET pairs are turned on, and when, thus controlling the printing on the closure 20. Each printed character is comprised of numerous individual impact wire markings. SRAM 60 assists MCU 51 by providing the required memory for determining which MOSFET pairs in wire driver 62 are to be turned on for each row printed.

Referring now to FIGS. 12B and 12C, for each print head 302 their is an opto-electronic edge detector 322. The edge detectors 322 sense, by reflection, the presence of a closure 20 directly in front of it. In the preferred embodiment printer 30 , the edge detectors 322 are located such that when they first sense the bottom side 208, see FIG. 3, of a closure 20, their associated print head 302 impact wires are located about 1/16th of an inch above that closure's bottom side 208. Thus, a 1/16th inch border exists between the closure's bottom side 208 and where printing begins.

The power supply unit 50, shown in FIGS. 1 and 10, includes a power supply 502, a battery back-up 504, an alarm relay 506, and a bi-directional remote I/O port 508. The power supply 502 powers the closer 40 and the printer 30. In the preferred embodiment, the power supply 502 provides a 12 VDC low voltage supply for system electronics, a 48 VDC medium voltage supply for stepper motors, relays and miscellaneous purposes, and a 300 VDC high voltage supply that is applied to the printer supply 328 and the foil drive power supply 330. The printer power supply 328 supplies 48V power to the print head 302 and the print head driver 324 while the foil drive power supply 330 supplies 48V power to the foil driver 326 and foil driver stepper motor 304. 12 VDC is supplied to the control panel 60, closer 40, and the printer 30 by the power supply 50.

The battery back-up 504 provides 12 VDC to the electronics in the closer 40 and printer 30 to retain stored information if external power is lost. The alarm relay 506 enables a user-specified alarm to be activated if a fault occurs. Finally the bi-directional remote I/O port 508 enables bi-directional communications, at RS-422 levels, between a remote computer up to 1500 meters away from the closer 40.

Figure 14:
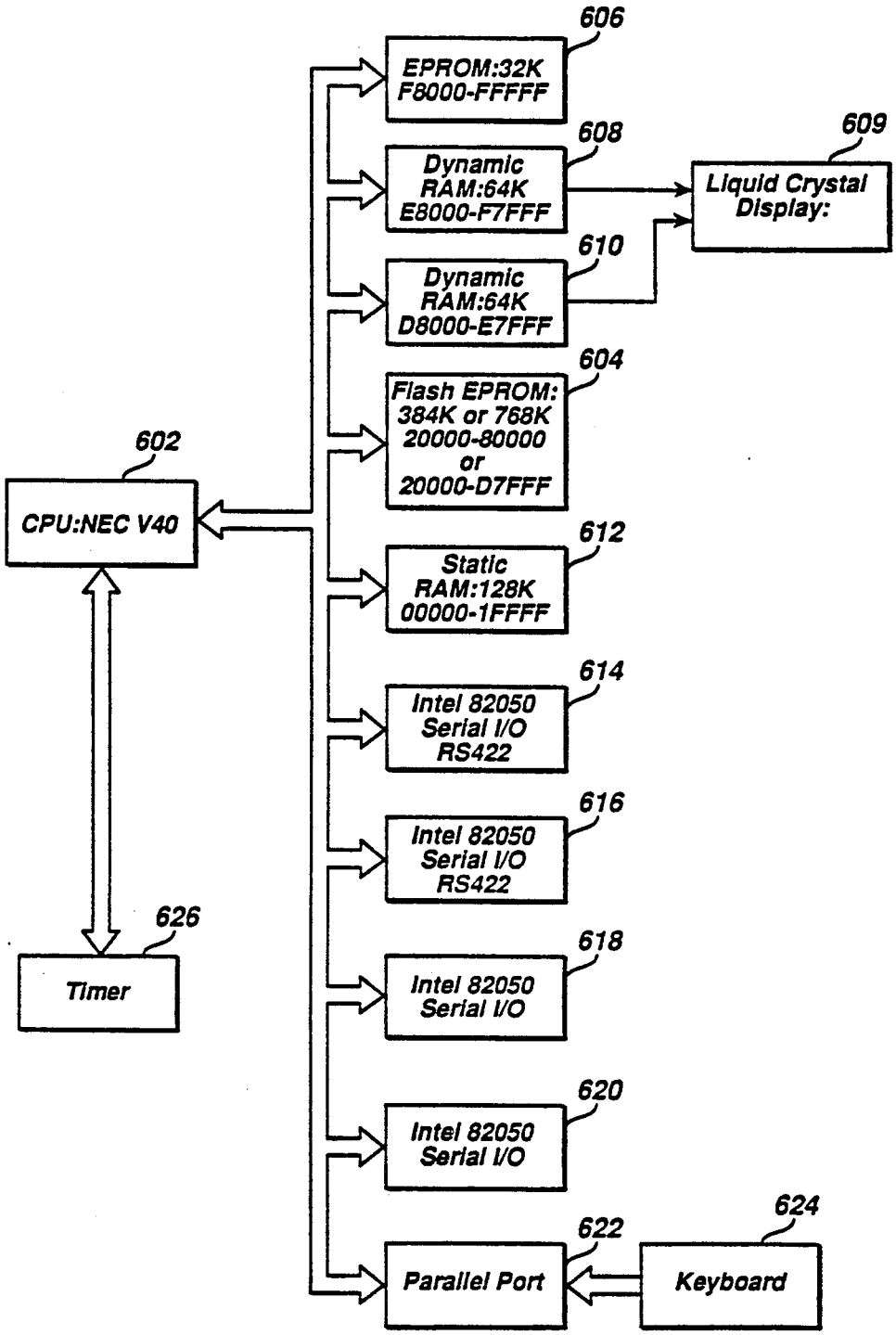
FIG. 14 is a schematic block diagram of the display/CPU assembly according to its preferred embodiment.

As shown in FIG. 1, the preferred embodiment system includes a control panel \CPU 60. The control panel \CPU 60, as shown schematically in FIG. 14, includes: a central processing unit, CPU 602; two electrically programmable read only memories, an EPROM 604 having 728K of memory and an EPROM 606 having 32K of memory; two dynamic random access memories, DRAM 608 and DRAM 610, both having 64K of memory; a liquid crystal display, LCD 609; a static random access memory, SRAM 612 having 128K of memory; four serial input-output ports, I/O 614 through 620; a parallel port I/O 622; and a keyboard 624.

The CPU 602, similar to the NEC V40 microprocessor, controls overall system operations. The MCU 51 of each driver boards are operated slaved to the CPU 602 via serial I/O devices as subsequently discussed. The operating program for the CPU 602 is permanently stored in the EPROM 604. A remote computer, via I/O 616, may receive information from the CPU 602, or may transmit information, such as operating commands, to the CPU 602. This enables remote system operation and communication. To increase the distance that the control panel \CPU 60 and the remote computer can be separated, the I/O 616 is operated at RS-422 levels.

Besides storing the operating program, the EPROM 604 also stores other information of a permanent nature, including historical data, various print fonts, and up to 500 programmed messages that can be printed on the closures 20. The historical data currently consists of: a fault condition log; display messages indicating operating conditions; warnings that are displayed if a fault occurs; and set-up data, including the maximum width of bags 10 to be closed by the closer 40. Additionally, preventative maintenance schedules, repair histories, statistical data, or other items of long term interest could also be stored. The system program in EPROM 604 contains code that causes the operating set-up and data to be stored within the EPROM 604 if the voltage of the battery back-up 504 drops, such as when external power has been off for extended periods of time. This prevents important data, such as messages being printed on the closures, from being lost.

Figure 15:
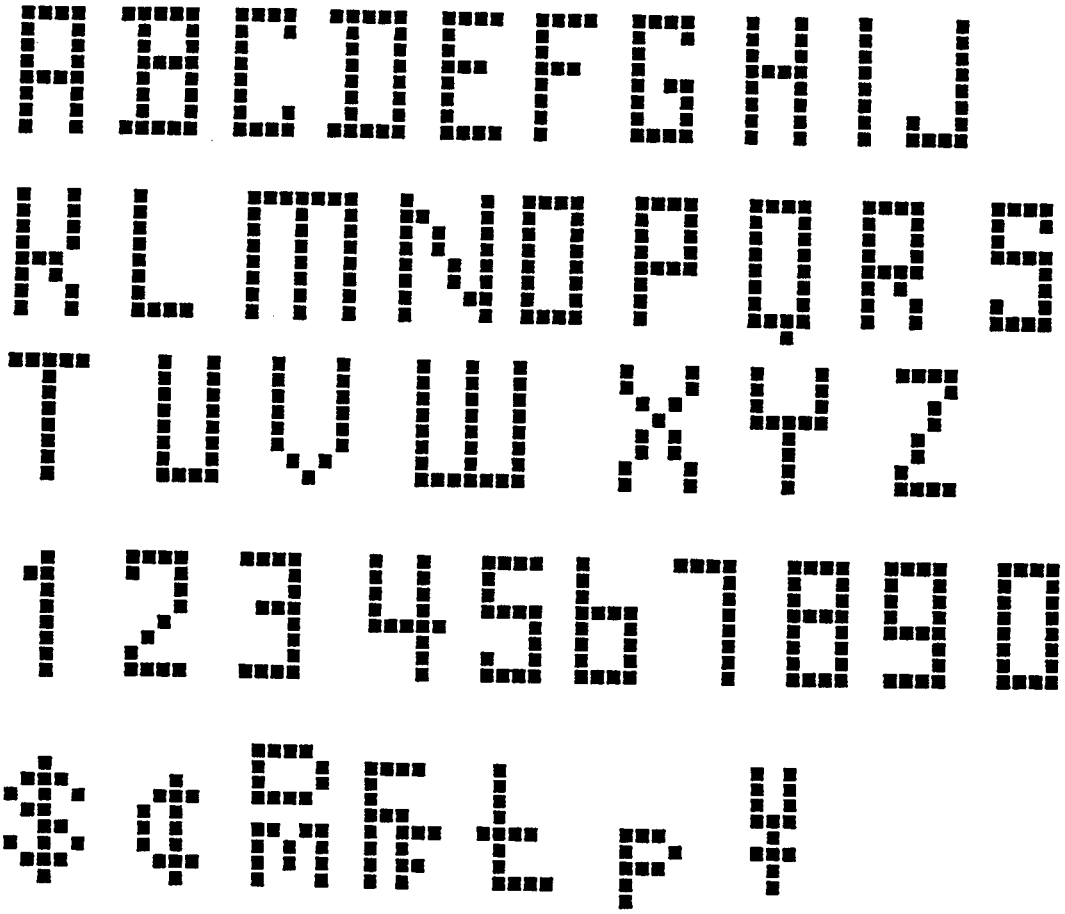
FIG. 15 is an illustration of the special fonts preferably used in the preferred embodiment printer.

The special fonts are important to make efficient use of the small closure marking surface 222. These special fonts reduce the widths of printed characters so that more information than would normally be possible can be placed on a closure 20. A sample of typical special fonts are shown in FIG. 15. The programs stored within the EPROM 604 are operator selectable, either at the keyboard 624, discussed below, or by a remote computer. Additionally, the programmed messages can be designed by an operator at the keyboard 624 or at a remote computer. These special fonts and programmed messages are transferred by the CPU 602 to the print head driver 324 via the I/O 620. This allows printed information to be quickly and easily changed electronically.

The EPROM 606 is a 32K memory that stores system boot strap or start up information, particularly the system communication routines, used to initialize system operation. Additionally, the two DRAM's 608 and 610 are used to control the liquid crystal display LCD 609. The DRAM 608 provides for LCD 609 timing control to control display brightness while DRAM 610 stores display data. The SRAM 612 is a 128K static RAM which is used for temporary storage of operating variables and as a system scratch pad. I/O 614, in the preferred embodiment, may be used to transfer conveyor belt speed to the CPU 602 so that the system operation is demand dependant. At the present time this feature is at the design stage. The I/O 618 is dedicated to bi-directional communication of stepper motor information between the CPU 602 and the previously discussed stepper motor drivers. I/O 620 is dedicated to bi-directional communication of printing information between the CPU 602 and the print head driver 324. A parallel port, Port 622, allows communication between the keyboard 624 and the CPU 602.

The liquid crystal display, LCD 609, is shown in FIG. 2A. In the preferred embodiment, LCD 609 is a Sharp model LM 24010Z liquid crystal display. The system program is written so that a sample closure can be displayed on the LCD 609. The displayed sample closure can indicate the message currently being printed on the closures 20, or it can provide a visual indication of a closure message being designed by the operator via the keyboard 624. Additionally, the historical data stored in the EPROM 604 includes information about system operating conditions and warnings that are displayed on the LCD 609. The keyboard 624, also shown in FIG. 2A, is a membrane-type keyboard specially constructed to house the LCD 609. The keyboard 624 can be used to operate the system and to design closure messages.

Figure 16:
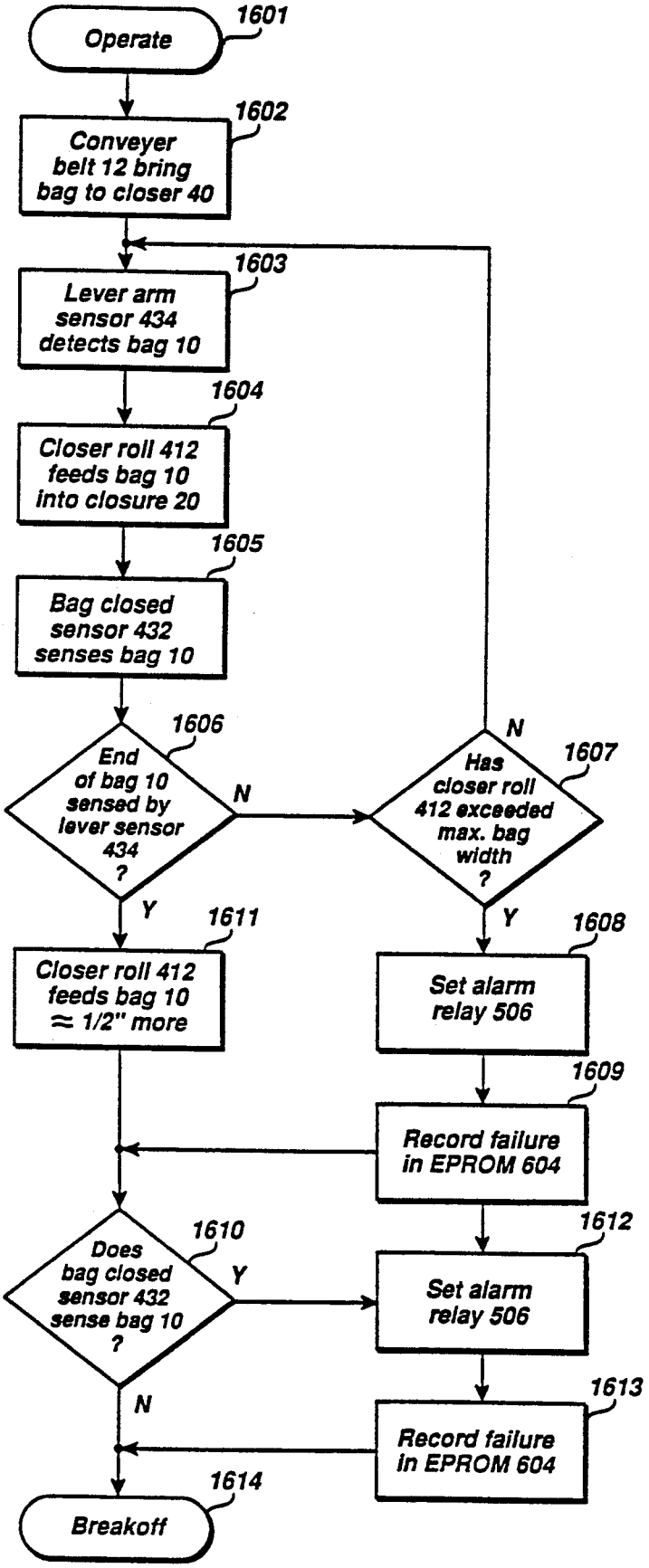
FIG. 16 is an operational flow diagram of the preferred embodiment system.

The interactions of the above structures is best explained by reviewing the operating flow diagram shown in FIG. 16. FIG. 16 illustrates the sequence used in the preferred embodiment system of marking a closure 20 and closing a bag 10. In the discussion that follows it is assumed that: a closer 40 and a printer 30, using a single print head 302, are properly loaded with closures 20 and foil 310; that the power supply unit 50 is supplying operating power; and that bags 10 are orientated properly on a conveyor belt 12. This state is indicated by block 1601. The conveyor belt 12 with the pre-filled bags 10 orientated as shown in FIG. 1, is moving the bags 10 toward the closer 40, as indicated by block 1602. As the conveyor belt 12 moves the bag 10 into the closer 40, the neck portion 120 of the bag 10 enters the bag guide 408, contacting and moving the lever arm 410. The lever sensor 430 senses the lever arm movement and transmits information to the CPU 602 that a bag 10 is ready for closing. The CPU 602 begins monitoring the width of the bag 10 using a timing program. These steps are indicated by block 1603.

The closing roll 412 is continually rotating at a speed which is controlled by the closing roll drive 448 to be sufficient to close the bag 10. Typically, the roll surface 414 operates at a lower velocity than in the prior art. After the bag 10 contacts the closing roll 412 and is pinched between it and the pressure roll assembly 428, see FIG. 9, the bag 10 is forced towards the closure opening 212. These operations are indicated by block 1604. When the bag 10 enters the opening 212 it is sensed by the optical "bag closed" sensor 432, shown in FIG. 8, as indicated by block 1605.

The CPU 602 has kept track of amount of closing roll 412 travel by keeping track of the rate of rotation of the closing roll stepper motor 416 and the elapsed time since the lever arm 410 moved. If the closing roll has not turned far enough to close the widest bag permitted by the program, and if the lever arm 410 has not returned to its normal position, then the closing roll 412 continues to feed the bag into the closure. This is indicated by the logic flow through blocks 1606, 1607, and back to block 1603. However, if the lever arm 410 is still not released when the maximum bag width has been exceeded, as shown by the logic flow through blocks 1606, 1607, and down to block 1608, the CPU 602 causes the alarm relay 506 to set as shown in block 1609, causing the customer supplied alarm to go off. In the preferred embodiment, a record of this "maximum bag width exceeded" fault is stored in EPROM 604 and system operation is returned to the normal flow as shown in block 1610. If, as shown by the logic flow through block 1606 to block 1611, the lever 410 is released within the allotted time, the lever sensor 430 transmits this information to the CPU 602. The CPU then continues to rotate the closing roll 412 approximately one-half inch more to force the portion of the bag 10 between the closure 20 and the lever arm 410 to be loaded, as indicated in block 1611.

As indicated in block 1610, whether the operational flow was via blocks 1609 or 1611, the system next determines whether the bag closed sensor 432 detects minimum portion of the bag 10 protruding from the opening 212. If the bag 10 is sensed by the bag closed sensor 432, this information is passed to the CPU 602, which causes the alarm relay 506 to set, and a record of the "improperly closed bag" fault condition to be recorded in the EPROM 604. System operation then passes to breakoff. These steps are indicated by logic flow through blocks 1612 and 1613 and to block 1614. However, if, as shown in the logic flow through block 1610 to block 1614, the bag closed sensor 432 does not detect a portion of the bag 10, breakoff is also initiated as shown in block 1614.

Breakoff refers to the mechanical separation of the end closure 220 from the other closures 20. The closure 20 adjacent to end closure 220 is restrained by the closure guide 404, as shown in FIG. 8. When the break-off solenoid 418 is actuated, the break-off solenoid lever 420 pivots, contacting the front edge 210 of the end closure 220 with sufficient force to break its webs 218.

In the preferred embodiment closer 40, special precautions are taken to increase the long-term reliability of the break-off solenoid 418. When breakoff is initiated as indicated in block 1614, the break-off solenoid driver 442 applies full power to the break-off solenoid 418 for an allotted period of time. These steps are indicated in blocks 1615 and 1616. This allotted time period is part of the system program stored in EPROM 604. After the allotted time period has elapsed, then, as shown in block 1617, the CPU 602, via the pick driver 446, causes the break-off solenoid driver 442 to begin chopping the power applied to the break-off solenoid 418. Preferably, the applied power decreases sinusodially. This sinusodially decreasing power is applied until the break-off solenoid lever 420 (1) has traveled a sufficient distance as detected by the break off sensor 421 or (2) until the CPU 602 determines that solenoid power has been applied for the maximum permitted time. These steps are shown by the logic flow through blocks 1617, 1618, 1619, and 1620A. In either case, the power to the break-off solenoid 418 is turned off, as shown in block 1620B. The effect of the sequence of steps in blocks 1614–1620B is that the break-off solenoid 846 is driven at full power only long enough to overcome its inertia and to reach a sufficient operating speed so that the inertia effects of the break-off components is sufficient to break the webs 218 of the end closure 220. These steps prevent damage by eliminating full power impacts into the mechanical stops of the break-off solenoid 418. The break-off solenoid 418 would have a significantly reduced life expectancy without these steps.

As shown in block 1621, the CPU 602 also monitors, via the pick driver 446, the time from turn-off of the break off power until the break-off sensor 421 senses the return of the solenoid arm 420 to its de-energized position. If this time is excessive, jamming of the break-off components may be occurring. As shown in the logic flow of blocks 1621, 1622, 1623, if the return time is excessive in consecutive operations of the break-off solenoid 418, a jam is determined to have occurred. However, if the time is not exceeded consecutively, a jam is not deemed to have occurred. This is shown by the logic flow through blocks 1621, 1622, 1624. The CPU 602 keeps track of whether the break-off solenoid arm 420 return time is exceeded consecutively by setting and clearing internal status flags as indicated by blocks 1624 and 1625. If a jam has not been detected, normal operation continues with a time delay sufficient to allow the now closed bag 10 to clear the closer 40, as indicated by block 1626. Next, the initiation of a pick/-print cycle as indicated in block 1627 occurs.

When any jam happens, for example as in block 1623, the jam sequence shown in blocks 1628 through 1634 takes place. The CPU 602 causes the alarm relay 506 to set as shown in block 1629. As previously indicated, what occurs when the alarm relay 506 sets is determined by the customer. Next, as shown in block 1630, a jam message is displayed on the LCD 609 indicating the nature of the jam. Next, as shown in block 1631, the closing roll stepper motor 416 is stopped. Operation is not resumed until an operator clears the jam and presses a button on the control panel 60. These steps are indicated by block 1632. As indicated in blocks 1633 and 1634, when the button on the control panel is pressed, the CPU 602 resets the system and operation is returned to the initial operating state of block 1601.

Assuming that the pick/print cycle of block 1627 has been reached, a new end closure 220 will be advanced to the bag closing position 406 and another closure 20 must be printed. These objectives are begun by initiating pick movement as shown in block 1635. This marks the start of the recycle time. The pick 422, shown in FIGS. 2B and 7A, is an eccentrically moved pawl that has a range of motion such that at the top of its stroke the contact surface 424 is above the top side 206 of a closure 20 in the closure guide 404. This is the pick's "home position." This is illustrated in block 1635. When the pick stepper motor 426, shown in FIG. 7B, begins rotating, the pick 422, see FIG. 2B, will begin moving down toward the top side 206. The movement of the pick 422 will cause (1) the end closure 220 to move to the bag closing position 406 and (2) another closure 20 to sweep past the print head 302. To properly mark a closure 20, its exact location must first be known. The edge detector 322 is used to accomplish this.

However, prior to actual pick 422 movement the edge detector 322 determines if the previously marked closure 20 is visible. If the edge detector 322 does not see it, the print head 302 is disabled, a warning message that the printer is unable to print is displayed on the display 609, the failure is recorded in the EPROM 604, and closer 40 operation, continues. The print head 302, not finding a closure present, stops. These steps are indicated by blocks 1636, 1637, 1638, 1639, and 1640. These steps help locate the closure 20 to be printed and help ensure that the print head 302 does not attempt to print on a missing closure 20 or within the various openings comprising closure 20.

Figure 17:
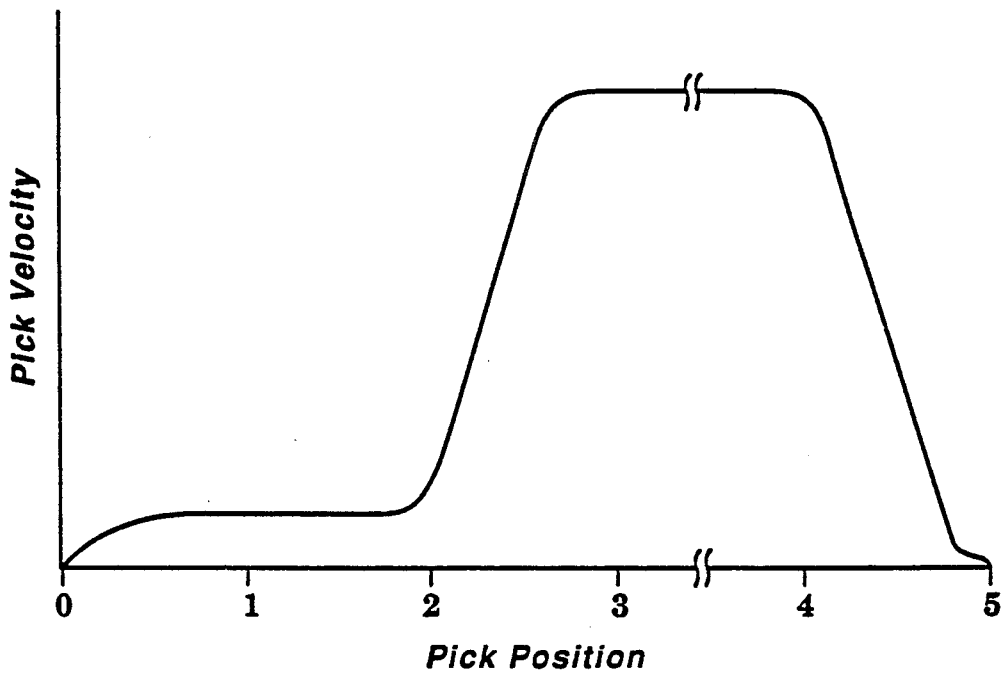
FIG. 17 is a graphical depiction of pick velocity versus pick position.

The pick 422 begins moving as illustrated in block 1635. As shown in FIG. 17, the pick 422 begins moving slowly. The pick at this time is between positions 0 and 1, where position 0 represent the home position and position 1 represents the pick position where the edge of the previous closure is first detected. At this time, as shown in block 1642, the CPU 602 begins keeping track of time and the edge detector 322 begins looking for the gap between neighboring closures 20.

If the edge detector 322 fails to detect the gap within an allotted time period, as indicated by the logic path through blocks 1643 and 1644 to block 1645, the print head 302 is disabled per block 1645, a warning signal is displayed that the closure was not detected per block 1646, a record of the failure is stored within the EPROM 604 per block 1647, and the closer 40, continues. The print head 302 does not find a closure 20 and stops per block 1648.

If the gap is found, the CPU 602 timer restarts as shown in block 1649, and the edge detector begins looking for the bottom side 208 of the closure to be printed. The pick driver 446 continues to cause the pick 422 to move at a constant rate, as shown in FIG. 17 between position 1 and position 2, where position 2 is the location of the bottom side 208 of the next closure 20. If, as indicated by logic flow through blocks 1650 and 1651 to block 1652, the bottom side 208 has not been found within the allotted time, the print head 302 is then disabled per block 1652, a missing closure warning is shown on the display 609 per block 1653, a record of the failure is kept in EPROM 604 per block 1654, and the closer 40 continues. The print head 302 does not find a closure 20 and stops per block 1655.

If the bottom side 208 of the next closure 20 is detected by the edge detector 322, as indicated by the logic flow from block 1650 to block 1656, the printing cycle begins per block 1656. The CPU 602 directs the pick driver 44 to begin accelerating the pick stepper motor 426. Faster rotation of the pick stepper motor 426 causes the pick 422 to begin accelerating, as indicated in block 1657. This is illustrated in FIG. 17 by the increase in pick velocity between position 2 and position 3, where position 3 represents the position at which the pick 422 achieves its fastest movement. Information on pick position is continuously transferred from the pick encoder 444 to the pick driver 446 as indicated in block 1658. Since the position of the closure 20 relative to the print head 302 is accurately known because of the action of the edge detector 322, and because the movement of the pick 422 is continuously monitored by the pick encoder 444, the pick driver 446 can cause the closure 20 to sweep in front of the print head 302 in a controlled manner.

Stored within the print head driver 324 is a message to be printed. The print head driver 324 decodes the message into rows of dots to be printed by the various impact wires of the print head 302, and stores the information in the SRAM 60. The print hed controller 30 knows when the closure is at a place where a row is to be marked because it monitors the pick 422 position given the pick driver 446 from the pick encoder 444. This action is indicated in blocks 1658 through 1662. If the last row of data to be printed has not occurred, the steps indicated between blocks 1658 through 1662 continue. When the last row is printed, the CPU 602 is informed, as illustrated in block 1663 and printing stops.

If at any time the edge detector 322 fails to detect the closure 20 to be printed, print head 302 is disabled per block 1664, a warning message of a missing closure is shown on the display 609 per block 1665, a record of the failure is stored in the EPROM 604 per block 1666, and the closer 40 continues. The print head does not find a closure 20 and stops per block 1667.

Because the print head 302 impact wires drive the marking material from the foil 310 into the closure 20, transferring the foil's coating to the closure, fresh foil 310 must be located between the impact wires of the print head 310 and the closure 20. However, to reduce maintenance and to eliminate waste of the foil 310 it is beneficial to control the rate at which the foil 310 is used. The foil 310 is removed from the foil spool 314 onto a take-up spool 316 when powered by the foil stepper motor 304. The movement of the foil stepper motor 304 is precisely controlled by the foil driver 326, under the direction of the CPU 602, when required. As illustrated in block 1661, when a row is printed, the closure 20 position is monitored per block 1668 and the stepper motor 304 is advanced so that new foil 310 is located under the print head 302 impact wires per blocks 1669 and 1670. Block 1669 is a decision block that determines whether the foil 310 has advanced far enough. In the preferred embodiment, foil movement stops when the print head driver reports printing has completed.

The operation of the printer 30 is also contingent upon the status of the out-of-foil switch 320. If the foil driver 326 detects that the printer is out-of-foil, per the logic of block 1671, the foil driver 326 stops driving the foil 310 and informs the CPU 602 of the condition. The CPU 602 causes a warning to be displayed on the display 609 per block 1672, and the alarm relay 506 is set per block 1673. The operator must replenish the foil supply and acknowledge the alarm per blocks 1673A and 1673B. Operation then resumes per block 1674.

If the CPU 602 has been informed that all rows have been printed, as illustrated in block 1663, all printing and driving of the foil 310 stops per block 1675. Referring now to FIG. 17, the pick stepper motor 426 has been moving the pick 422 at its maximum velocity, shown between positions 3 and 4. At this time the pick 422 is caused to return to its home position, per block 1676, for the next cycle. The home position is set by the pick home sensor 438. The pick home sensor 438 provides a fixed reference point to which the pick must and will return. Because the pick driver 446 accurately controls the pick position. If the pick 422 does not return home, a jam is deemed to have occurred by the CPU 602, which sets the alarm relay 506 and stops system operation as indicated in block 1677. As shown in FIG. 17 between positions 4 and 5, where position 5 is home, as the pick 422 approaches its home position the pick 422 is decelerated until it comes to rest at its home position. At this time the preferred embodiment system is ready for the next operating cycle.

I claim:

1. A method of printing an image on a closure that is a closure within a strip of a plurality of closures, each of said closures in said strip having a marking area, using a bag closure assembly and a print head including the steps of:

advancing a first closure within a closer assembly using a closure advancing means in the closure assembly, said closure being coupled to the strip of the plurality of closures, the entire strip being advanced simultaneously with the first closure at a closure strip advance speed by the closure advancing means;

mounting a print head in a fixed position adjacent said strip of closures and upstream of said closure assembly along the moving strip of closures;

moving a second closure with respect to the print head, said second closure being one closure of the plurality of closures within said strip of closures, the second closure being caused to move past said print head at the closure strip advance speed by the closure advancing means in the closure assembly, simultaneous with said first closure advancing within said closure assembly; and printing a symbol on said second closure simultaneously with the second closure being advanced past the print head at said closure strip advance speed by the closure advancing means such that the printing is synchronized with the closure strip advance speed as advanced by the closure advancing means in the closer assembly to print on the second closure a sit is advanced by the closure advancing means.

2. The method of claim 1, further including the steps of:

determining when the marking area on said second closure beings moving in front of said print head;

decoding an electronic signal to determine the symbol to be printed on the second closure;

sensing the speed at which said first closure moves into said closure assembly; and synchronizing the printing with the position of the second closure to print said symbols on said second closure based on the speed at which said first closure is moving into said closure assembly.

3. The method of claim 1, wherein the step of mounting the print head includes the steps of:

attaching said print head with a hinge on a rigid surface; and fixing the print head at a stable position using a clasping means.

4. The method according to claim 1, further including:

moving said second closure at a selected speed as it is being printed on by said print head, the speed of said second closure being synchronized with said print head to print symbols on said second closure with the proper spacing being obtained by moving said second closure with respect to said print head while printing on said closure.

5. The method according to claim 4, further including:

moving said second closure at a first speed as it approaches said print head; and moving said second closure at a second speed during said printing operation, said second speed being faster than said first speed, such that said second closure moves at a relatively slow speed when approaching said print head and moves at a faster speed during the printing.

6. The method according to claim 5, further including:

sensing when a closure is moving into position for printing; and increasing the speed of said closure after it has been sensed in a position for printing.

7. The method according to claim 1, further including the steps of:

inserting a bag into said first closure after said first closure is positioned within said closer assembly;

breaking said first closure off of said strip to separate said first closure from said strip; and advancing said strip to move another closure into said closer assembly, while simultaneously printing on a third closure within said strip as the another closure is moving into said closure assembly.

8. The method according to claim 7, further including the steps of:

sensing the width of the bag to be inserted into said first closure;

sensing when said bag is completely within said closure; and outputting the signal indicating that said bag is in said first closure.

9. The method according to claim 8, further including the step of:

outputting an alarm signal if said bag is not fully inserted into said closure after a selected maximum bag width has been exceeded.

10. The method according to claim 7, further including the steps of:

rotating a first stepper motor to drive said bag into said closure;

driving a separate drive assembly to separate said first closure from said strip of closures;

rotating a second stepper motor to move said strip forward to advance another closure into said closer assembly, the speed of said first and second stepper motors being at a preprogrammed speed.

* * * * *

UNITED STATES PATENT AND TRADEMARK OFFICE

CERTIFICATE OF CORRECTION

PATENT NO. : 5,269,120

DATED : December 14, 1993

INVENTOR(S) : Jack H. Holmes

It is certified that error appears in the above-identified patent and that said Letters Patent is hereby corrected as shown below:

In column 15, line 35, claim 1, please delete "closure" and substitute therefor --closer--.

In column 15, line 42, claim 1, after "in the" and before "assembly", please delete "closure" and substitute therefor --closer--.

In column 15, line 61, claim 2, please delete "closure" and substitute therefor --closer--.

In column 15, line 65, claim 2, after "into said" and before "assembly", please delete "closure" and substitute therefor --closer--.

Signed and Sealed this

Twenty-eighth Day of June, 1994

Bruce Lehman

*Attest:*

BRUCE LEHMAN

*Attesting Officer*

*Commissioner of Patents and Trademarks*